US006604876B2

(12) United States Patent
Bryant et al.

(10) Patent No.: US 6,604,876 B2
(45) Date of Patent: Aug. 12, 2003

(54) SYSTEM FOR DISSIPATING ELECTROSTATIC CHARGE IN A PRINTER

(75) Inventors: Caleb Bryant, Moorpark, CA (US); Philip Alan Mastinick, Camarillo, CA (US); Lawrence E. Smolenski, Newbury Park, CA (US)

(73) Assignee: ZIH Corp., Wilmington, DE (US)

( * ) Notice: Subject to any disclaimer, the term of this patent is extended or adjusted under 35 U.S.C. 154(b) by 58 days.

(21) Appl. No.: 09/964,721

(22) Filed: Sep. 26, 2001

(65) Prior Publication Data

US 2002/0048479 A1 Apr. 25, 2002

Related U.S. Application Data

(63) Continuation-in-part of application No. 09/675,193, filed on Sep. 29, 2000, now Pat. No. 6,494,631.

(60) Provisional application No. 60/292,093, filed on May 17, 2001.

(51) Int. Cl.[7] ..... B41J 32/02

(52) U.S. Cl. ..... 400/208; 400/694; 400/120.01; 347/214

(58) Field of Search ..... 400/208, 196, 400/88, 472, 692, 694, 20.01; 347/209, 203, 205, 207, 214, 215

(56) References Cited

U.S. PATENT DOCUMENTS 1,848,871 A * 3/1932 Corlett et al. ..... 361/220
2,483,542 A * 10/1949 Hooper ..... 361/213
2,778,635 A * 1/1957 Eash ..... 361/222
3,601,654 A * 8/1971 Lung et al. ..... 361/221
3,636,408 A * 1/1972 Shuman ..... 361/221
4,350,453 A * 9/1982 Field et al. ..... 400/208
4,591,284 A * 5/1986 Lim et al. ..... 361/220
4,620,255 A * 10/1986 Cook et al. ..... 242/346.2
4,632,585 A * 12/1986 Oyamatsu et al. ..... 400/613
4,683,478 A * 7/1987 Suzaki et al. ..... 347/214
4,689,639 A * 8/1987 Kimura et al. ..... 347/215
4,718,785 A * 1/1988 Spath ..... 400/224.2
4,738,554 A * 4/1988 Tajima ..... 400/208
4,754,290 A * 6/1988 Kitayama et al. ..... 400/196
RE32,897 E * 3/1989 Salmon et al. ..... 347/209
4,855,757 A * 8/1989 Wiklof et al. ..... 347/205
4,887,921 A * 12/1989 Hayashi et al. ..... 400/196.1
5,128,763 A * 7/1992 Sakuragi ..... 400/208
5,165,806 A * 11/1992 Collins ..... 400/208
5,193,919 A * 3/1993 Godo et al. ..... 400/208
5,383,733 A * 1/1995 Zinsmeyer et al. ..... 400/208
5,424,757 A * 6/1995 Thom ..... 400/120.01
5,424,760 A * 6/1995 Wirth et al. ..... 400/120.01
5,475,548 A * 12/1995 Rudi et al. ..... 361/220
5,609,429 A * 3/1997 Fogle et al. ..... 400/692
5,672,020 A * 9/1997 Leonard et al. ..... 400/692
5,741,080 A * 4/1998 Tomoda et al. ..... 400/208
5,791,796 A * 8/1998 Gustavsson et al. ... 400/120.01
5,846,621 A * 12/1998 Nagamatsu ..... 428/40.1
5,932,643 A * 8/1999 Kenny ..... 524/276
5,938,351 A * 8/1999 Hamisch, Jr. et al. ..... 400/208

* cited by examiner

*Primary Examiner*—Eugene H. Eickholt

(57) ABSTRACT

A system for dissipating electrostatic charge build-up in printers comprises a ribbon frame made of statically dissipative material and adapted to support a printhead bracket on which a thermal printhead is mounted proximate to a rotating platen. The statically dissipative ribbon frame may be grounded to the printer power supply which in turn is grounded to the main printed circuit board assembly (PCBA) of the printer which is connected to earth ground. The electrostatically dissipative material in the ribbon frame automatically dissipates static electric charge as the moving ribbon comes into physical contact with at least one portion of the grounded ribbon frame during printer operation. The printhead bracket may also be made of statically dissipative material and grounded to the PCBA. The electrostatically dissipative material in the printhead bracket automatically dissipates static electric charge as the moving ribbon comes into physical contact with at least one portion of the grounded printhead bracket.

17 Claims, 16 Drawing Sheets

SYSTEM FOR DISSIPATING ELECTROSTATIC CHARGE IN A PRINTER

RELATED APPLICATIONS

This application is a continuation-in-part of U.S. patent application Ser. No. 09/675,193, filed Sep. 29, 2000, now U.S. Pat. No. 6,494,631 entitled "Printer With Ribbon Fold Out Mechanism", having common inventor and assignee, the contents of which is incorporated herein by reference. This application claims the benefit of U.S. provisional patent application Ser. No. 60/292,093, filed May 17, 2001, entitled "System For Dissipating Electric Charge During Printing", having common inventors and assignee, the contents of which is incorporated herein by reference.

BACKGROUND OF THE INVENTION

1. Field of the Invention

The present invention relates generally to printers and more particularly to a system for dissipating a build-up of static electric charge in thermal transfer printers during printing. The present invention also relates to a ribbon fold out mechanism mounted in the lid of a thermal printer to facilitate loading of ribbon media and printhead maintenance.

2. Prior Art

A thermal printer is normally provided with a printhead which comprises a large number of exothermic resistors arranged on an electrically insulating base. By selectively applying electric current to the exothermic resistors, heat is generated and applied to a thermo-sensitive print medium so as to print characters, pictures or both. The basic construction of a conventional thermal transfer printer includes a platen, thermal printhead, ribbon supply and take up mechanism, stepping motor and a gear train for driving the platen. A continuous strip of print media (e.g., paper, cloth, etc.) usually from a clamped print media roll is positioned between the platen and the ribbon with the thermal printhead caused to press the ribbon against the print media thereby printing characters or pictures on the print media strip using heat generated from the thermal printhead.

One of the most important aspects for the user in setting up a thermal transfer printer for printing is ribbon and media loading. Ribbon loading in conventional thermal transfer printers is a complicated, generally undesirable task which frequently involves ten or more steps. The usual steps are unlatching the printer, opening the lid of the printer, loading the ribbon supply roll, loading the ribbon take up roll, opening up the ribbon mechanism, threading the ribbon, wrapping the ribbon around the ribbon mechanism, taping it to the ribbon take up roll, taking up the ribbon slack, closing the lid of the printer and finally, re-latching the printer. Of the above-described steps, ribbon threading is usually the most difficult step to accomplish and as such can be a source of frustration for the user. Media loading usually requires the user to thread the media under or through the ribbon mechanism. Furthermore, conventional thermal transfer printers do not provide easy access to the thermal printhead for maintenance which adds to the overall cost of meeting the printing needs of the average user.

Electrostatic charge build-up has also been a long-standing problem associated with thermal transfer printing. Electrostatic charge build-up is mainly due to the motion of the ribbon as it passes between the printhead and a rotating rubber platen. The ribbon normally includes a Mylar™ film which builds up significant amount of electrostatic charge as it moves past the printhead in close proximity to the linearly disposed electrical printing elements in the printhead which produce significant amount of heat during operation. This build-up of electrostatic charge can cause premature failure of the printhead and/or other components of the thermal transfer printer if not dissipated.

The conventional way of handling the electrostatic build-up problem in thermal transfer printers has been to ground the entire system using static brushes located proximate the thermal printhead. This type of setup adds complexity and cost to the printing system.

SUMMARY OF THE INVENTION

The present invention is directed to a system for automatically dissipating static electric charge build-up caused substantially by the passage of a moving ribbon between a rotating platen and a thermal printhead without the use of static brushes.

In accordance with one aspect of the present invention, the system comprises a ribbon frame made substantially of electrostatically dissipative material and adapted to support the thermal printhead proximate to the rotating platen, a power supply unit electrically coupled to the ribbon frame for grounding the ribbon frame to the power supply, and a printed circuit board assembly (PCBA) electrically coupled between the power supply and earth ground for grounding the power supply. The electrostatically dissipative material in the grounded ribbon frame automatically dissipates static electric charge as the moving ribbon comes into physical contact with at least one portion of the ribbon frame.

In accordance with another aspect of the present invention, the system comprises a ribbon frame made substantially of electrostatically dissipative material, a printhead bracket removably coupled to the ribbon frame and made substantially of the same electrostatically dissipative material wherein the printhead bracket is adapted to support the thermal printhead proximate to the rotating platen, and a printed circuit board assembly (PCBA) electrically coupled between the printhead bracket and earth ground for grounding the printhead bracket. The electrostatically dissipative material in the grounded printhead bracket automatically dissipates static electric charge as the moving ribbon comes into physical contact with at least one portion of the printhead bracket.

These and other aspects of the present invention will become apparent from a review of the accompanying drawings and the following detailed description of the preferred embodiments of the present invention.

BRIEF DESCRIPTION OF THE DRAWINGS

The present invention is generally shown by way of example in the accompanying drawings in which.

DETAILED DESCRIPTION OF THE PREFERRED EMBODIMENTS

Figure 1:
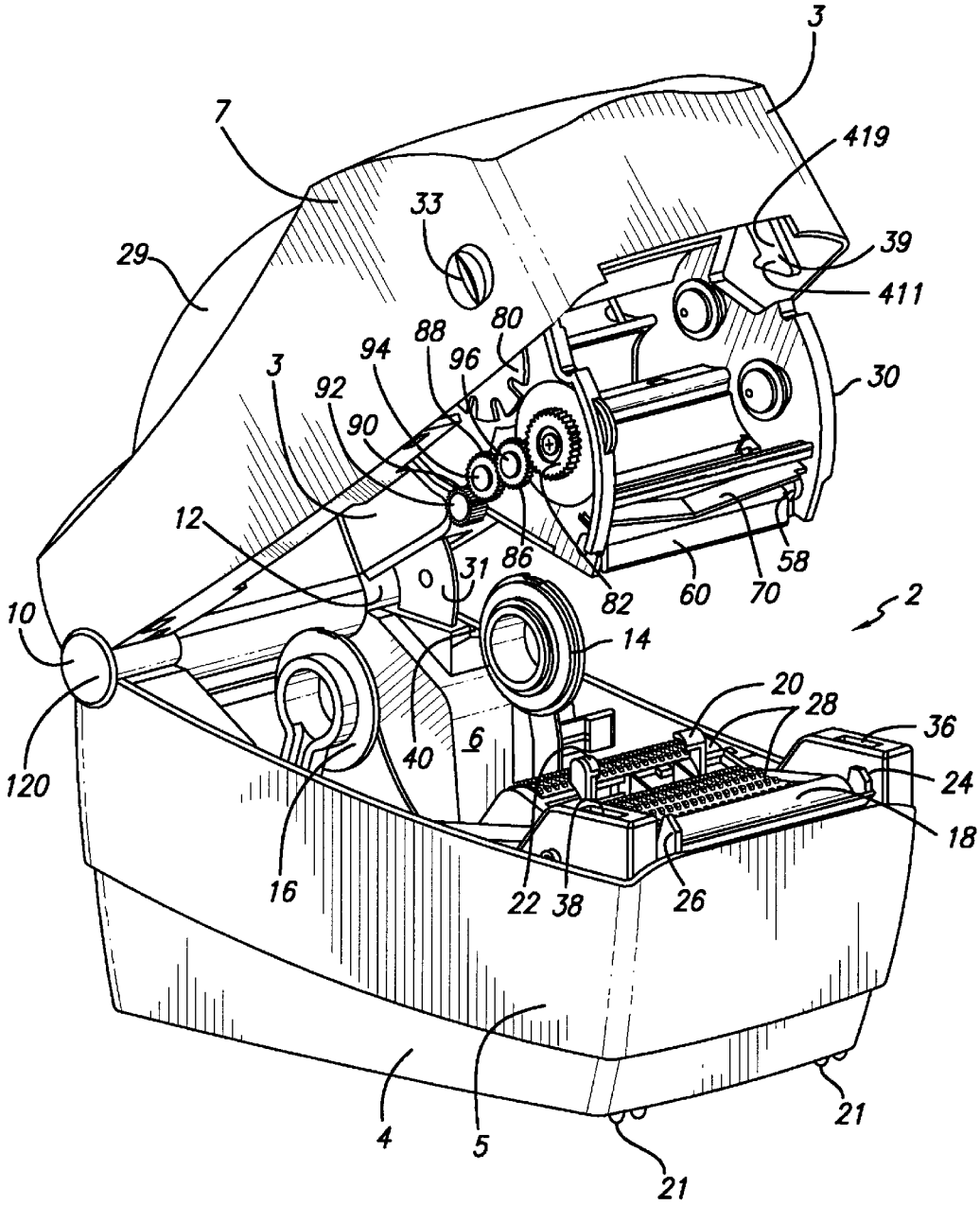
FIG. 1 is a perspective view of a printer in accordance with the present invention.

Hereinafter, some preferred embodiments of the present invention will be described in detail with reference to the related drawings of FIGS. 1–21. Additional embodiments, features and/or advantages of the invention will become apparent from the ensuing description or may be learned by the practice of the invention.

In the figures, the drawings are not to scale and reference numerals indicate the various features of the invention, like numerals referring to like features throughout both the drawings and the description.

The following description includes the best mode presently contemplated for carrying out the invention. This description is not to be taken in a limiting sense, but is made merely for the purpose of describing the general principles of the invention.

The present invention is directed to a printer, generally referred to by reference numeral 2, which can be used for thermal transfer printing (with ribbon) or for direct thermal printing (without ribbon) as needed by a user (FIG. 1).

As generally shown in FIGS. 1–4, printer 2 comprises a base 4 having a lower frame 6 hinged to an upper frame 8 of a printer lid 3 by way of hinges 10, 12. Hinge 12 is an integral part of lower frame 6, while hinge 10 is a separate removable part adapted for mounting to one end of lower frame 6. Lower frame 6 is screwed to a base cover 5 to form base 4 and upper frame 8 is screwed to a lid cover 7 to form printer lid 3. The bottom of base cover 5 may be provided with a plurality of support legs, such as support legs 21 in FIG. 1.

Lower frame 6 is used for mounting a platen 18, a pair of adjustable print media (paper, cloth and the like) roll holders 14, 16, a pair of adjustable print media guides 20, 22, a pair of printhead alignment tabs 24, 26, a lower gear train 201 (FIG. 14—one of the gears is not shown), a stepping motor 13 (FIG. 14) and a main circuit board (not shown) for controlling the operation of printer 2. A portion 28 on the outer surface of lower frame 6 is conventionally ribbed to reduce the surface contact area for the passing print media. Base 4 may be further provided in the back with a power switch (not shown), a power jack (not shown) for coupling an external power supply, a serial port (not shown), a parallel port (not shown) and/or a universal serial bus (USB) port (not shown) for connecting printer 2 to a computer or other device.

Figure 10:
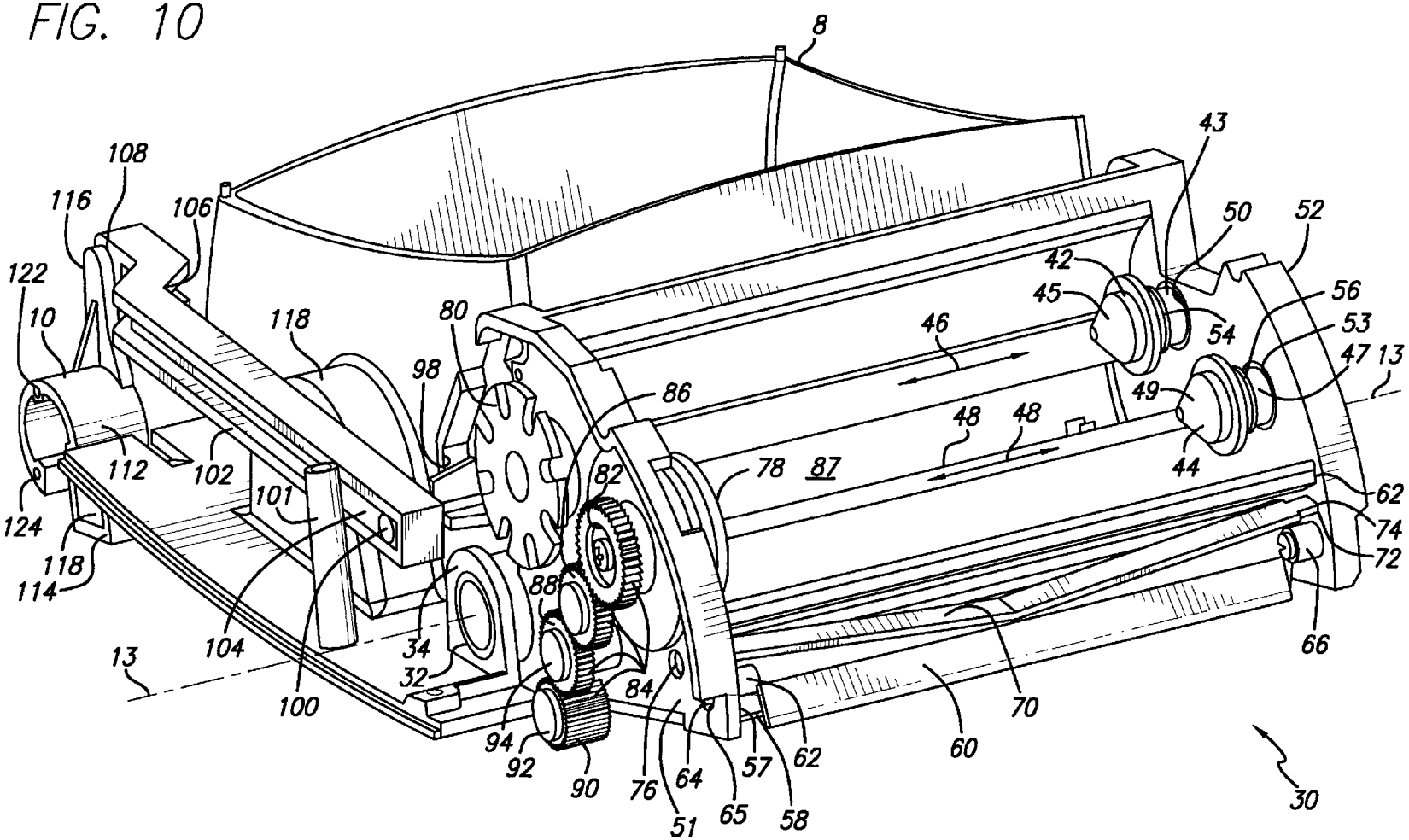
FIG. 10 is a perspective view of the internal structure of the printer lid shown in FIG. 9 in accordance with the present invention.
Figure 11:
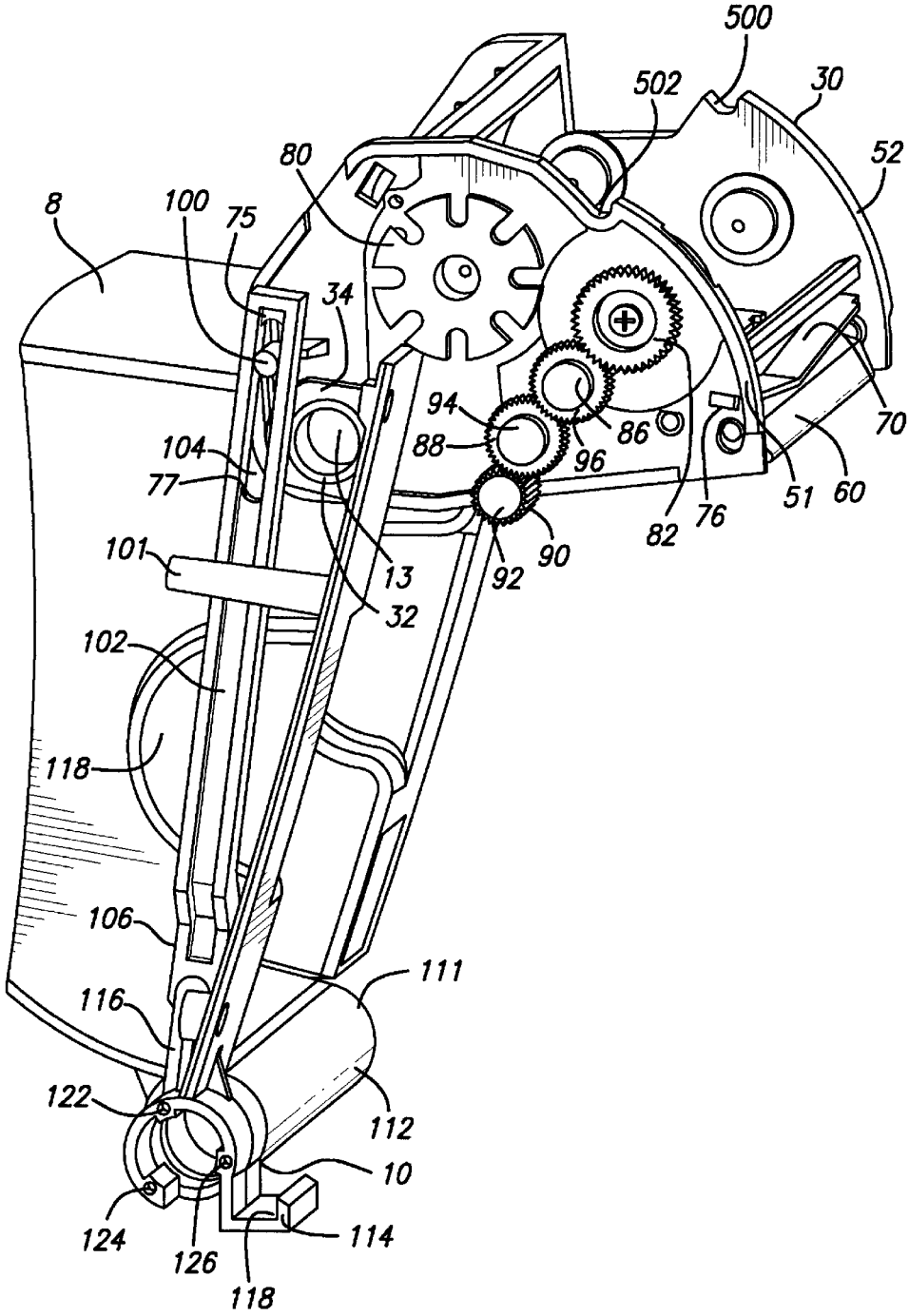
FIG. 11 is a perspective view of yet another preferred embodiment of the present invention.

Upper frame 8 is used to pivotally mount a ribbon carriage 30 designed to receive a ribbon supply roll (not shown), a ribbon take up roll/core (not shown) and a thermal printhead 58 (FIG. 10). Ribbon carriage 30 may be injection molded as one piece from a suitable light-weight material. For example, ribbon carriage 30 may be injection molded from polycarbonate material containing 15% carbon fiber and 2% silicone for stiffness and static charge dissipation. The ribbon take up roll/core is driven by an upper gear train 84 (FIGS. 3, 4, 8) mounted on one side of ribbon carriage 30. Upper gear train 84 is driven by lower gear train 201 which in turn is driven by a shaft 203 (FIG. 14) of stepping motor 13.

Figure 12:
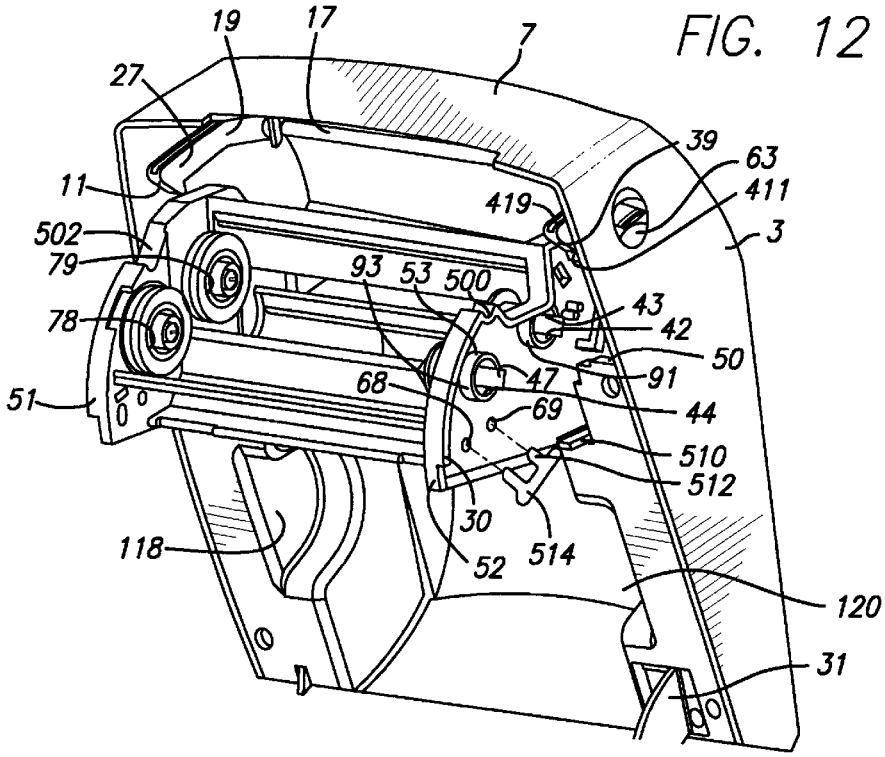
FIG. 12 is a perspective view of a printer lid for use in accordance with the present invention.
Figure 15:
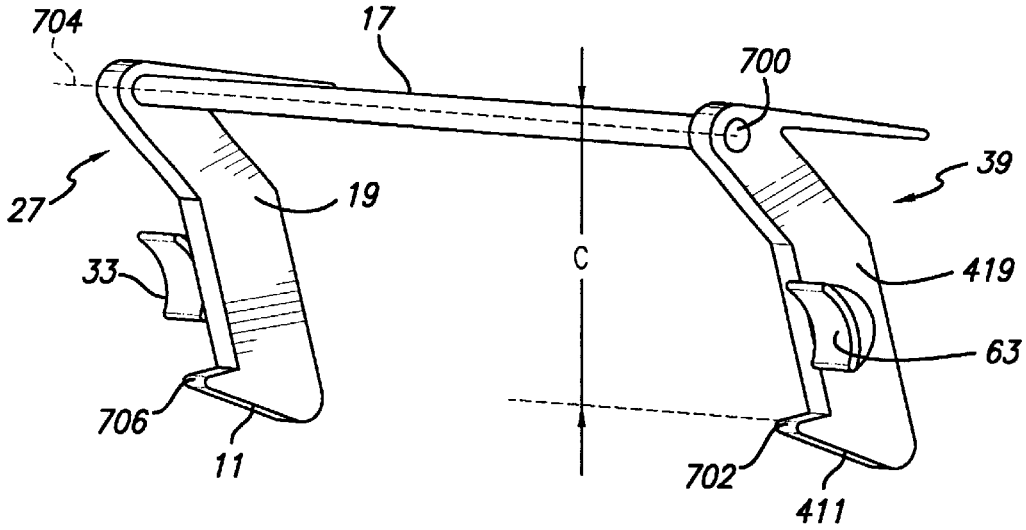
FIG. 15 is a perspective view of a latching system for use in accordance with the present invention.
Figure 16:
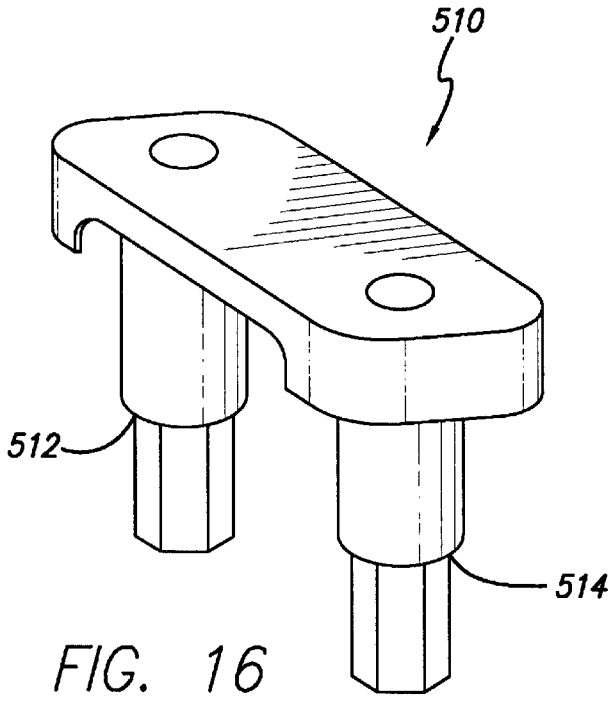
FIG. 16 is a perspective view of a mounting clip for use in accordance with the present invention.

Lid 3 is preferably provided with a see-through dome 29 to permit lid 3 to be closed with a large roll of print media (paper) held by adjustable print media roll holders 14, 16. Lid 3 is also provided generally in its top portion with a pair of spaced apart latches, such as latch 39 in FIG. 1 and latch 27 in FIG. 12. Latch 27 has a generally hook-like body 19 which ends with a substantially flat outer foot 11 for engaging a corresponding latch opening 38 (FIG. 1) provided at the front end of lower frame 6 of base 4 when lid 3 is in a fully closed position so as to lock printer 2 during printer operation. As illustrated in FIGS. 1 and 12, latch 39 similarly has a generally hook-like body 419 which ends with a substantially flat outer foot 411 for engaging a corresponding latch opening 36 (FIG. 1) provided at the front end of lower frame 6 of base 4. As shown in FIGS. 12 and 15, latch 27 and latch 39 are mounted on a latch shaft 17 made preferably of light weight metal (such as aluminum) with latch shaft 17 hinged generally in the upper inner portion of lid 3 on a pair of integral spaced apart plastic clips (not shown). Latch 27 is provided with an integral latch release 33 (FIGS. 1, 15) for manually turning latch 27 inward (toward the interior of lid 3) so as to release (unlock) lid 3 from base 4. Similarly, latch 39 is provided with an integral latch release 63 (FIGS. 12, 15) for manually turning latch 39 inward (toward the interior of lid 3) so as to release (unlock) lid 3 from base 4.

Furthermore, as shown in FIGS. 1–4, a lid lock 31 is provided for automatically locking lid 3 in a fully open position in accordance with the present invention. Lid lock 31, which is preferably made of plastic and shaped generally as an annular strip, is mounted at one end of upper frame 8 for mating with a corresponding lid lock slot 40 provided respectively at one end of lower frame 6 (FIGS. 1–4). Lid lock 31 has a generally outwardly (toward the exterior side wall of base 4) curved bottom portion 37 for engaging a corresponding channel 41 provided adjacent lid lock slot 40. Lid lock 31 is mounted at one end of upper frame 8 such that its outwardly curved bottom portion 37 is aligned for automatic engagement in channel 41 when lid 3 is fully open to prevent lid 3 from closing by itself. To close lid 3, the user manually pushes lid lock 31 inward (toward the interior of lower frame 6) to disengage bottom portion 37 of lid lock 31 from channel 41 which allows lid lock 31 to move frictionally inside slot 40 (i.e., acts like a spring) as lid 3 is closed by the user. At the fully open position for lid 3, lid lock 31 automatically snaps out of slot 40 with its outwardly curved bottom portion 37 engaging channel 41 to prevent lid 3 from closing on its own by virtue of its mass. Other lid lock arrangements may be used, provided such other arrangements do not deviate from the intended purpose of the present invention.

Ribbon carriage 30 is provided on one side with a spring-loaded plastic supply hub 42 and a spring loaded plastic take up hub 44 disposed proximate to supply hub 42 for removably engaging one end of a ribbon supply roll and a ribbon take up core, respectively (FIG. 10). As shown in FIG. 12, ribbon carriage 30 is provided on the other side with a take up clutch assembly 78 and a supply clutch assembly 79 disposed proximate to take up clutch assembly 78 for removably engaging the other end of a ribbon take up/supply roll, respectively. Supply clutch assembly 79 is mounted (e.g., screwed) on a plastic fan-like supply spindle 80 disposed on the other (exterior) side of side wall 51 of ribbon frame 30 (FIGS. 10, 12). Take up clutch assembly 78 is mounted (e.g., screwed) on a take up gear 82 disposed on the other (exterior) side of side wall 51 of ribbon frame 30 (FIGS. 10, 12) which takes up ribbon slack.

Figure 8:
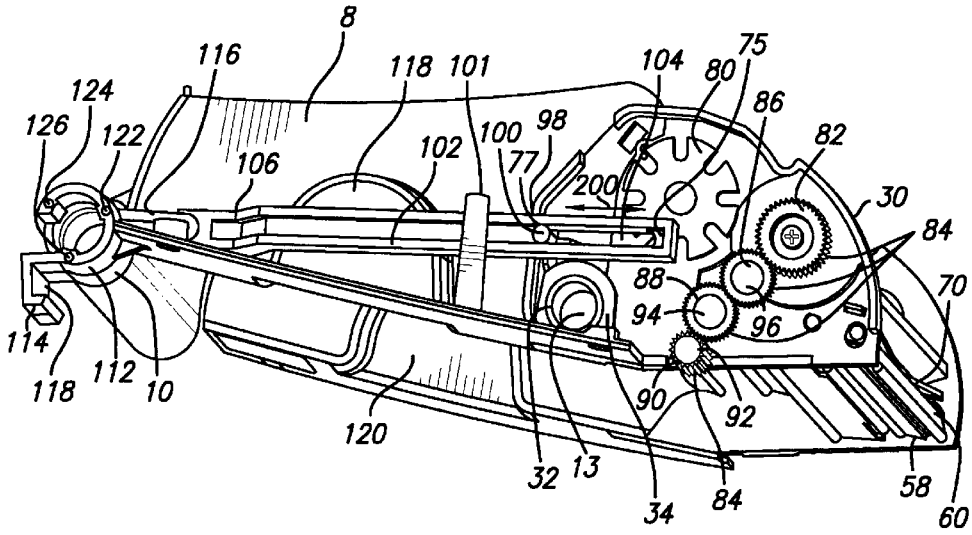
FIG. 8 is a perspective view of the internal structure of the printer lid shown in FIG. 7 in accordance with the present invention.

As shown in FIGS. 8 and 10, take up gear 82 is part of an upper gear train 84 (FIG. 8) which also includes a first idler gear 86 operatively coupled between take up gear 82 and a second idler gear 88 which, in turn, is operatively coupled between first idler gear 86 and a transfer gear 90. When lid 3 is fully closed, power from lower gear train 201 is transferred to upper gear train 84 by way of transfer gear 90 which in this position is operatively coupled to a third idler gear 202 (FIG. 14) which is part of lower gear train 201.

Figure 14:
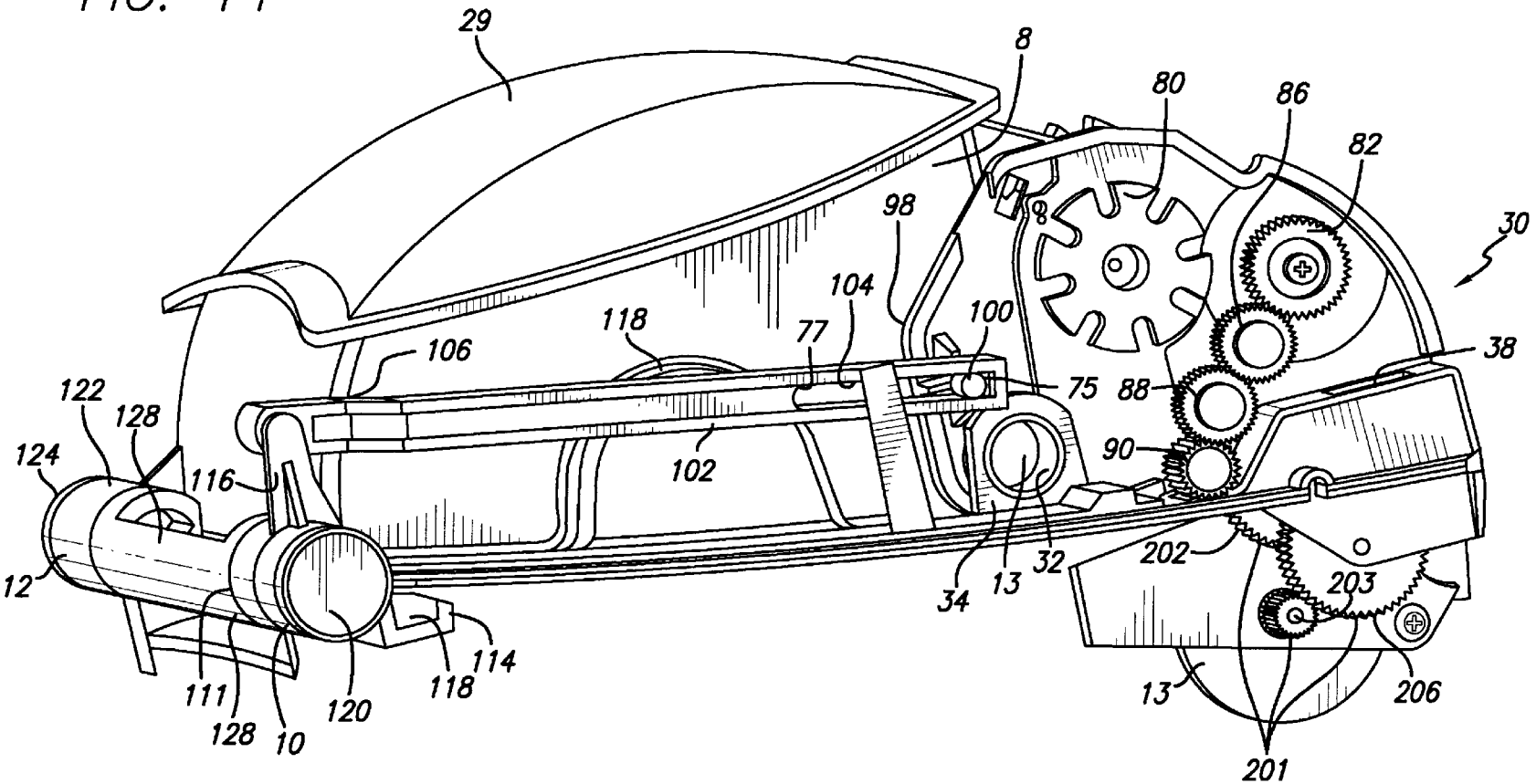
FIG. 14 is a perspective view of a different embodiment of the present invention.

As shown in FIG. 14, lower gear train 201 is mounted on lower frame 6 of base 4 and further includes a pinion gear 204 coupled to shaft 203 of stepping motor 13, a compound gear 206 driven by pinion gear 204 and a platen gear (not shown) coupled to the shaft (not shown) of platen 18 for driving platen 18 during printer operation. Compound gear 206 drives third idler gear 202 which in turn drives the platen gear. The operation of stepping motor 13 is controlled by the main circuit board (not shown). A stepping motor suitable for practicing the present invention may be purchased from Mitsumi Electronics Corporation of Santa Clara, Calif. First and second idler gears 86, 88 and transfer gear 90 are preferably mounted on the exterior side of side wall 51 of ribbon frame 30 with press-in pins 96, 94, 92, respectively, for easy mounting (FIG. 10).

As shown in FIG. 10, supply hub 42 has a cylindrical hollow body 43 with a cone-shaped integral cap 45. Cylindrical hollow body 43 is movably mounted in an aperture 50 of side wall 52 of ribbon carriage 30. Cylindrical body 43 is preferably spring loaded with a coiled helical spring 54 coupled between the bottom of cone-shaped cap 45 and the interior surface of side wall 52 of ribbon carriage 30. Spring 54 allows cylindrical body 43 to be displaced linearly within aperture 50 as shown by arrow 46 during manual loading and unloading of a ribbon supply roll by the user. As best shown in FIG. 12, the back portion of cylindrical hollow body 43 is provided with stop tabs 91 which abut against the outer surface of aperture 50 on the exterior side of side wall 52 preventing cylindrical hollow body 43 from slipping inside aperture 50.

Similarly, take up hub 44 has a cylindrical hollow body 47 with a cone-shaped integral cap 49. Cylindrical body 47 is movably mounted in an aperture 53 of side wall 52 of ribbon carriage 30. Cylindrical hollow body 47 is preferably spring loaded with a coiled helical spring 56 coupled between the bottom of integral cone-shaped cap 49 and the interior surface of side wall 52 of ribbon carriage 30. Spring 56 allows cylindrical body 47 to be displaced linearly within aperture 53 as shown by arrow 48 during manual loading and unloading of a ribbon take up roll (core) by the user. As best shown in FIG. 12, the back portion of cylindrical hollow body 47 is provided with stop tabs 93 which abut against the outer surface of aperture 53 on the exterior side of side wall 52 preventing cylindrical hollow body 47 from slipping inside aperture 53. Other types of ribbon roll loading arrangements may be used in conjunction with ribbon carriage 30 as long as such arrangements fall within the scope of the present invention.

As further illustrated in FIG. 10, ribbon carriage 30 is also used for mounting a floating thermal printhead 58 of the type described in U.S. Pat. No. 6,068,415 to Smolenski, assigned to the assignee of the present application, the disclosure of which is incorporated herein by reference. A thermal printhead suitable for the practice of the present invention may be purchased, for example, from Rohm Co., Ltd. of Kyoto, Japan.

Thermal printhead 58 is fastened with two screws (not shown) to the underside of a generally V-shaped printhead support bracket 60 (FIG. 10) preferably made of the same material as ribbon carriage 30 and removably hinged at each end to side walls 51, 52 of ribbon carriage 30, respectively. Thermal printhead 58 is electrically connected by way of cables 62 with the main circuit board (not shown) housed in base 4 of printer 2. A main circuit board suitable for use with the present invention can be purchased, for example, from the assignee of the present invention.

As depicted in FIG. 10, printhead support bracket 60 is preferably backed up by a compression leaf spring 70 which can be made from a steel strip bent to a certain extent generally in the middle. Leaf spring 70 is removably attached to side wall 52 of ribbon frame 30 by way of a first integral elongated leg 72 and a corresponding leaf spring aperture 74 in side wall 52 and to side wall 51 of ribbon frame 30 by way of a second integral elongated leg (not shown) and a corresponding leaf spring aperture 76 (FIG. 11) in side wall 51 of ribbon frame 30. In one example, leaf spring 70 may be made from a generally V-shaped 0.050 inch thick steel strip.

As shown in FIG. 10, printhead support bracket 60 is removably mounted to side wall 51 of ribbon carriage 30 by way of a pair of integral mounting posts such as post 64 (second post not shown) and a pair of corresponding printhead support bracket apertures such as aperture 65 (FIG. 10) on side wall 51 of ribbon carriage 30 (second aperture not shown) adapted for mating with the pair of integral mounting posts such as post 64.

Printhead support bracket 60 is removably mounted to side wall 52 of ribbon carriage 30 by way of a pair of integral hollow bosses such as hollow boss 66 in FIG. 10 (second boss not shown), a pair of corresponding printhead support apertures 68, 69 (FIG. 12) on side wall 52 of ribbon carriage 30 adapted for mating with the pair of integral hollow bosses such as hollow boss 66 and a press-in printhead clip 510 (FIGS. 12, 16) which has two prongs 512, 514, respectively, adapted for insertion (FIG. 12) from the exterior side of side wall 52 through apertures 68, 69 into the respective pair of integral hollow bosses (such as boss 66) of printhead support bracket 60 to allow easy mounting/dismounting of printhead support bracket 60 by the user. Each pair of printhead support bracket apertures on wall 51 or wall 52 is appropriately cut to allow the integral mounting posts and the clipped hollow bosses of printhead support bracket 60 and, therefore, mounted printhead 58 to move or "float" to a certain extent in all three dimensions within their respective apertures on side walls 51, 52 to allow for adjustment of the orientation of printhead 58 vis-a-vis platen 18 for printer operation.

A person skilled in the art would readily appreciate that other methods of attaching and/or backing up thermal printhead 58 may be utilized, provided such other methods do not deviate from the intended purpose of the present invention.

To load a ribbon supply roll, the user pulls the adhesive strip from the ribbon supply roll free (not shown), extends the leader (not shown) through a ribbon carriage cutout 87 (FIG. 10) and couples (not shown) the ribbon supply roll between supply clutch assembly 79 and supply hub 42 which are shaped to accommodate and securely hold each end of the ribbon supply roll during printer operation. To load a ribbon take up roll (core), the user couples the ribbon take up roll between take up clutch assembly 78 and take up hub 44 (not shown) which are shaped to accommodate and securely hold each end of the ribbon take up roll during printer operation. Having installed the ribbon supply and take up rolls, the user pulls (not shown) the leader around printhead 58 and sticks (not shown) the adhesive strip to the take up roll. The user then manually winds take up gear 82 counter-clockwise (towards the installed ribbon supply roll) until the black ribbon portion is visible on the ribbon take up roll which completes the ribbon loading procedure (not shown).

Figure 4:
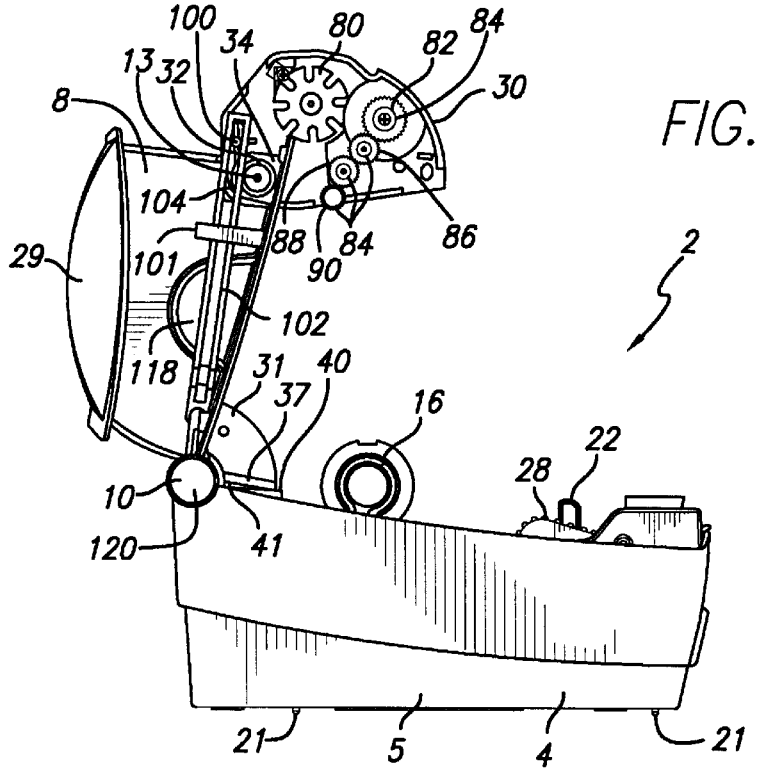
FIG. 4 is a side view of the printer shown in FIG. 3 in accordance with the present invention.
Figure 3:
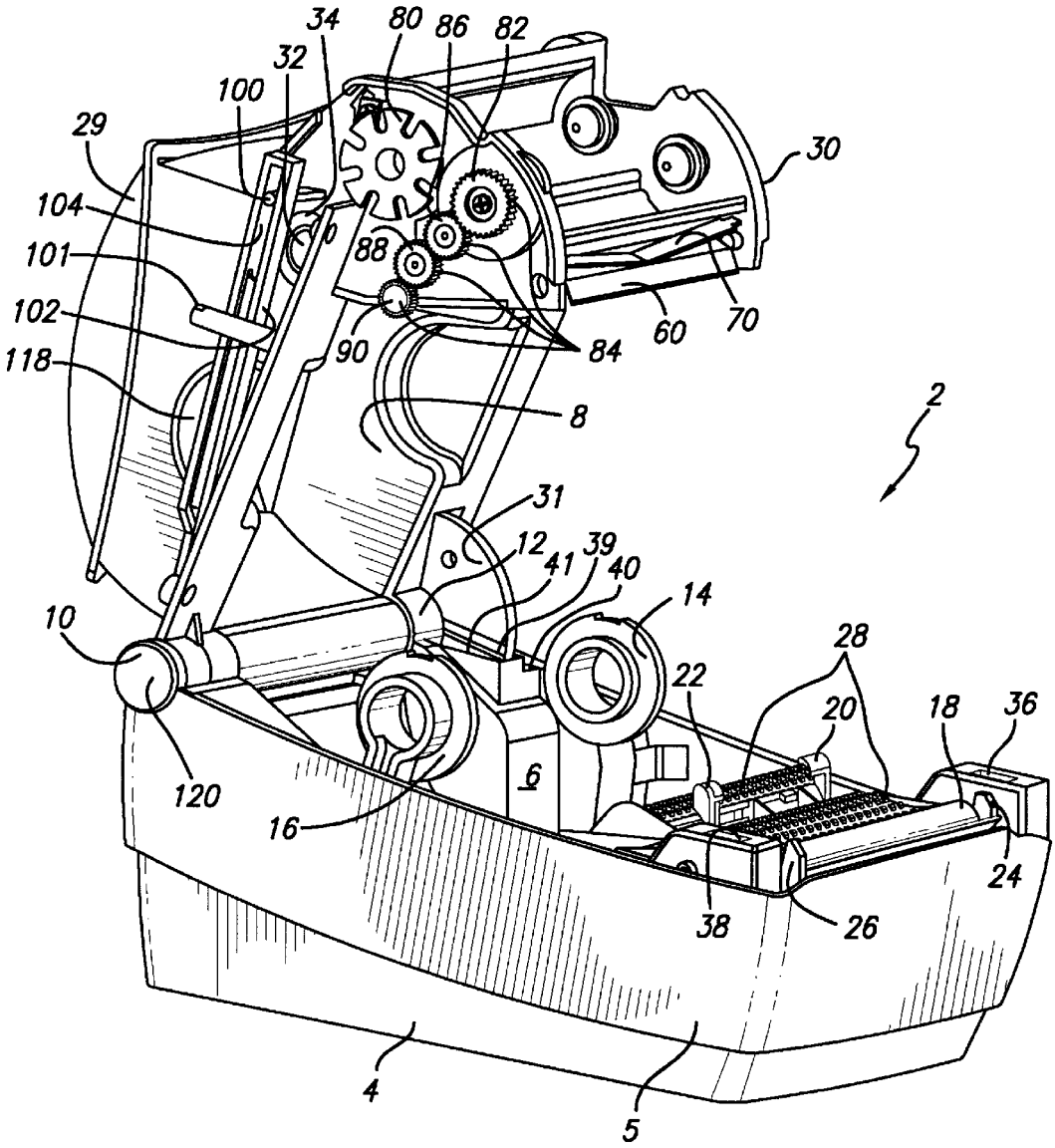
FIG. 3 is a perspective view of the printer of FIG. 1 showing the internal structure of the printer lid in accordance with the present invention.
Figure 7:
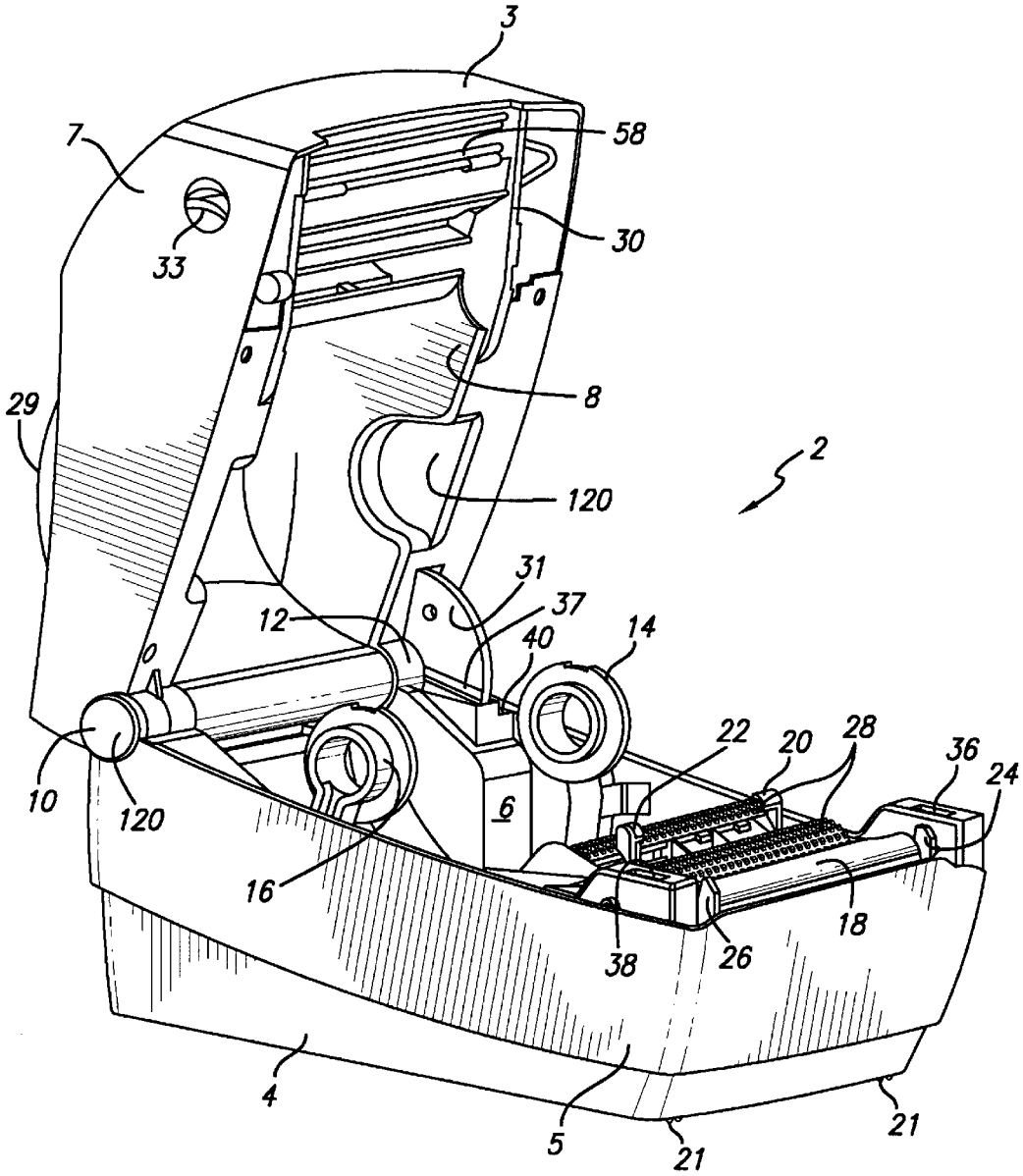
FIG. 7 is perspective view of a preferred embodiment of the present invention.

As further illustrated in FIGS. 4, 10 and in accordance with a preferred embodiment of the present invention, ribbon carriage 30 is hinged on each side to upper frame 8 of lid 3 by way of a pair of integral hollow cylindrical posts 32 (second post not shown) which mate with a corresponding pair of circular slots 34 (second circular slot not shown) provided on upper frame 8. A ribbon carriage axis of rotation (hinge axis) 13 may thus be defined through the center of hollow cylindrical post 32 as depicted in FIG. 10. As illustrated in FIGS. 1, 7, upper frame 8 and ribbon carriage 30 are configured to allow ribbon carriage 30 to rotatably fold in and out of lid 3 within a pre-determined angular range. Other materials, configurations and/or angular ranges may be used to practice the invention, provided such other materials, configurations and/or angular ranges fall within the scope of the present invention.

Figure 5:
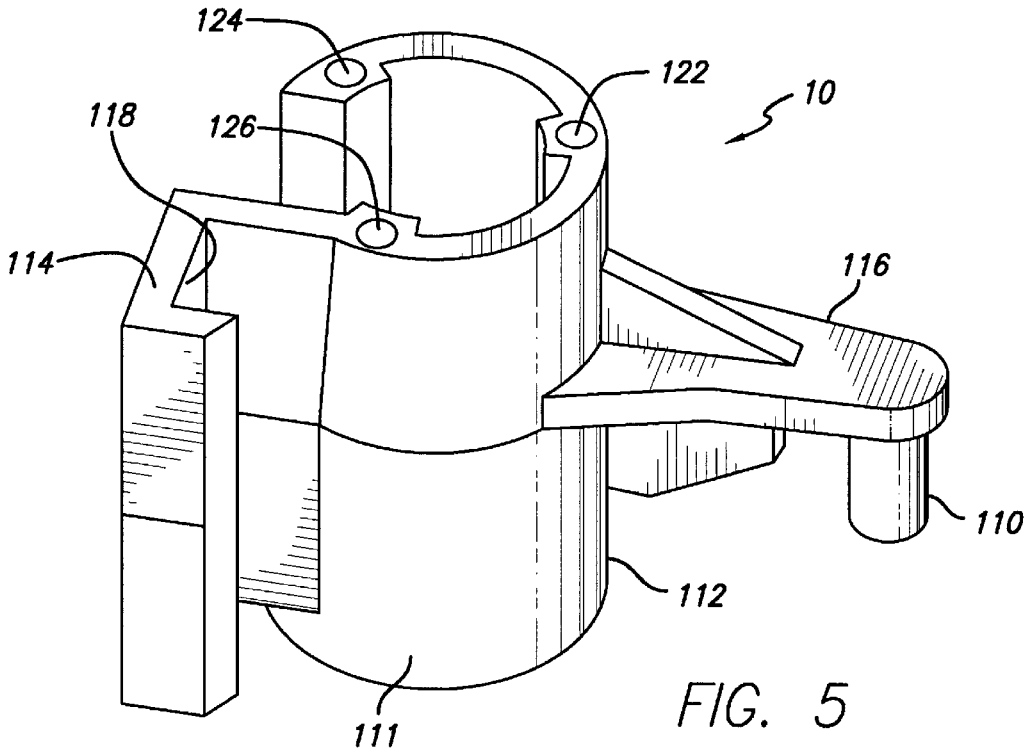
FIG. 5 is a perspective view of a hinge for use with the printer of FIG. 1 in accordance with the present invention.
Figure 6:
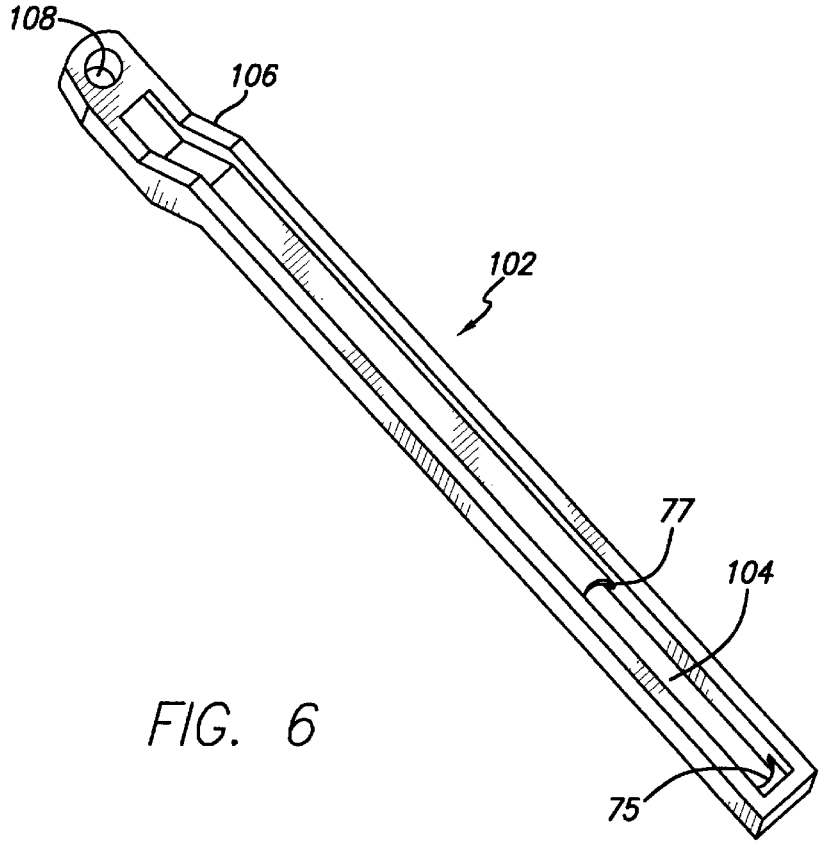
FIG. 6 is a perspective view of a linkage for use with the hinge of FIG. 5 in accordance with the present invention.

In accordance with another preferred embodiment of the present invention, a back portion 98 (FIG. 10) of ribbon carriage 30 is movably linked to printer hinge 10 by way of an elongated plastic linkage 102 (FIGS. 6, 10). Linkage 102 is preferably of I-beam-type construction for optimal structural strength and is provided at its ribbon carriage end with a generally rectangular slot 104 (FIGS. 6, 10) for movably accommodating a ribbon carriage post 100 which is an integral part of back portion 98 of ribbon carriage 30 (FIG. 10). Linkage 102 is hinged at the other end to printer hinge 10 by way of an aperture 108 (FIG. 6) adapted for receiving a lever arm 110 (FIG. 5) of hinge 10. Linkage 102 also has a jog 106 (FIG. 10) which, in the shown configuration, is needed to clear a bulge 118 (FIG. 10) provided on one of the exterior sides of upper platform 8 for accommodating print media roll holder 16 in accordance with the present invention. Thus, linkage 102 is captured between bulge 118 and a side boss 101 which is an integral part of upper frame 8 as shown in FIGS. 8–11. An identically shaped bulge 120 (FIGS. 7–8, 12) is provided on the other exterior side of upper frame 8 for accommodating print media roll holder 14, respectively. Other upper frame and linkage configurations may be utilized to practice the present invention provided such other configurations agree with the intended purpose of the present invention.

Linkage 102 has a stationary pivot at its printer hinge end and a dynamic pivot at its ribbon carriage end in accordance with the present invention. Dynamic pivoting is a result of ribbon carriage post 100 sliding linearly inside slot 104 of linkage 102 between a maximum "down" (FIG. 8) and a maximum "up" (FIG. 14) position, as shown by bi-directional arrow 200 in FIG. 8, as ribbon carriage 30 rotates about hinge axis 13 (FIG. 10) when lid 3 is being opened by the user for ribbon loading or printhead cleaning. Maximum "down" position for ribbon carriage post 100 is at a bottom end 77 of slot 104 of linkage 102 (FIGS. 6, 8) and corresponds to ribbon carriage 30 being in a fully folded in state, i.e. manually pushed all the way in lid 3 (lid 3 being in a fully open position) by the user for cleaning thermal printhead 58 (see also FIG. 7). Maximum "up" position for ribbon carriage post 100 is at a top end 75 (FIG. 6) of slot 104 of linkage 102 (FIGS. 9,14) and corresponds to lid 3 being in a fully closed position with floating printhead 58 aligned behind printhead alignment tabs 24, 26 (FIG. 1) in accordance with the present invention.

Figure 13:
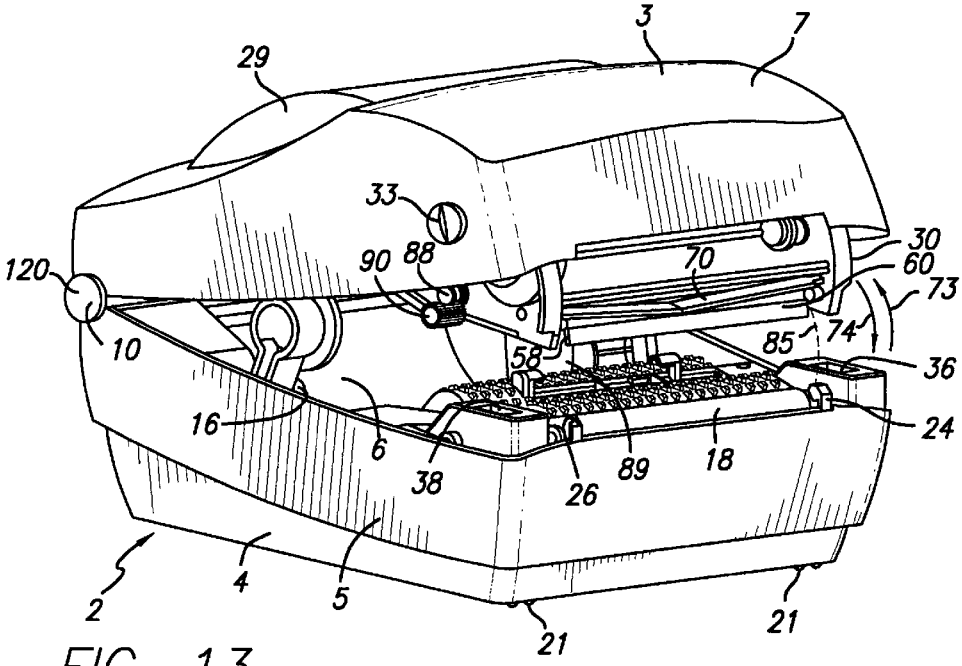
FIG. 13 is a perspective view of still another preferred embodiment of the present invention.

In accordance with the best mode for practicing the invention, as lid 3 is being opened from a fully closed position by the user, ribbon carriage 30 by virtue of its mass (i.e. under the force of gravity) rotates downwards (towards lower frame 6) about hinge axis 13 (FIG. 10) by itself. In other words, as lid 3 is being opened, ribbon carriage 30 automatically folds out of lid 3 with the motion of the front edge of printhead 58 describing a downward arc 71 (FIG. 13). When lid 3 reaches a fully open position (lid lock 31 automatically latches lid 3 in the fully open position), ribbon carriage 30 is in a fully folded out state (FIGS. 1–4, 11) automatically presenting itself for easy ribbon and media loading. This is a marked improvement over the prior art method of loading new ribbon and media which involves a great number of steps and expenditure of time not to mention being frequently a source of frustration for the average user. When ribbon carriage 30 is in a fully folded out state, the position of ribbon carriage post 100 inside slot 104 is slightly offset from top end 75 of slot 104 as shown, for example, in FIG. 11 in accordance with the general principles of the present invention.

Figure 9:
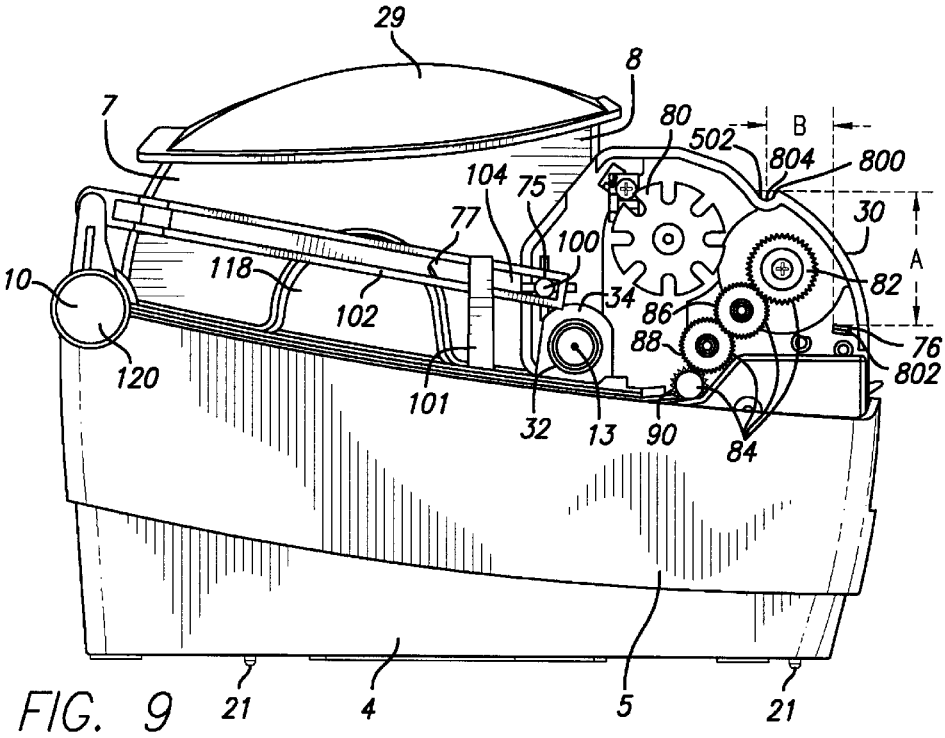
FIG. 9 is a side view of another preferred embodiment of the present invention.

If printhead 58 is in need of maintenance, the user manually folds ribbon carriage 30 fully inside lid 30 as shown in FIG. 7 for cleaning printhead 58. After cleaning printhead 58, the user may either manually fold ribbon carriage 30 out from inside lid 3 to its fully folded out state before proceeding with closing of lid 3 or leave ribbon carriage 30 in a fully folded in (inside lid 3) state and proceed with closing lid 3 whereby at some point during closing, ribbon carriage 30 by virtue of its mass (i.e. under the force of gravity) will automatically fold out of lid 3 completely after which ribbon carriage 30 will begin to rotate upwards (towards upper frame 8) about hinge axis 13 by itself. In other words, as lid 3 is being closed, ribbon carriage 30 automatically folds in lid 3 with the motion of the front edge of printhead 58 describing an upward arc 73 (FIG. 13). When lid 3 reaches a fully closed position, ribbon carriage 30 is in a fully folded in (inside lid 3) state (FIGS. 9, 14). When ribbon carriage 30 is in a fully folded in state, the position of ribbon carriage post 100 inside slot 104 is at top end 75 of slot 104 as shown, for example, in FIGS. 9, 14 in accordance with the general principles of the present invention.

In order to ensure proper positioning of floating thermal printhead 58 for printing during closing of lid 3, the angular motion of ribbon frame 30 about hinge axis 13 is timed to allow the two front edge portions of printhead 58 which are not covered by V-shaped printhead support bracket 60 (see, for example, front edge portion 57 of printhead 58 in FIG. 10) to gradually "sneak up" (align) behind alignment tabs 24, 26 as shown by arcs 85, 89 in FIG. 13. Alignment of a floating thermal printhead (such as printhead 58) behind alignment tabs (such as alignment tabs 24, 26) in a thermal transfer printer of this type is described in U.S. Pat. No. 6,068,415 to Smolenski, assigned to the assignee of the present application, the disclosure of which is incorporated herein by reference.

Furthermore, to properly bias (i.e. to apply the proper amount of pressure on) printhead 58 against platen 18 for printing, ribbon carriage 30 is provided with a pair of oppositely spaced recesses 500, 502 on the top portions of side walls 52, 51 of ribbon carriage 30, respectively, (FIG. 12) which are shaped for mating with latch shaft 17 (FIGS. 12, 15) when ribbon carriage is in a fully folded in state (inside lid 3), i.e. when lid 3 is fully closed for printer operation. Thus, latch shaft 17, which serves in this case as an end stop for the rotational movement of ribbon carriage 30 about hinge axis 13, presses against recesses 500, 502 of ribbon carriage 30 when lid 3 is filly closed (for printer operation) which translates into corresponding biasing of printhead 58 against platen 18 by way of leaf spring 70 and V-shaped printhead support bracket 60. Therefore, ribbon carriage 30 is sandwiched between latch shaft 17 and platen 18 when lid 3 is filly closed for printer operation.

In this regard, a person skilled in the art would readily appreciate that distance C (FIG. 15), defined, for example, between center 700 on latch shaft axis 704 of latch shaft 17 and front edge 702 of foot 411 of latch 39 as well as distance A, defined, for example, between top edge 800 of recess 502 on side wall 51 and top edge 802 of leaf spring aperture 76 as projected in FIG. 9, and distance B, defined, for example, between bottom 804 of recess 502 on side wall 51 and top edge 802 of leaf spring aperture 76 as projected in FIG. 9 are critical distances in order to get the correct printhead spring deflection and the critical distances are tightly toleranced in order to keep the desired printhead alignment required for printing.

As shown in FIG. 5, printer hinge 10 comprises a plastic cylindrical hollow body 112 having a mounting leg 114 which has a groove 118 for mating with a corresponding hinge protrusion (not shown) provided on the underside of lower frame 6. After inserting the hinge protrusion in groove 118, mounting leg 114 is screwed to lower frame 6. Printer hinge 10 also has a substantially vertical stem 116 equipped with a lever arm 110 disposed at about 90 degrees to vertical stem 116 for insertion in aperture 108 of linkage 102 during printer assembly. Hinge 10 is also provided with a hinge cap 120 (FIGS. 1–4) which has three mounting legs (not shown) on its underside for mating with corresponding apertures 122, 124, 126 (FIG. 5).

Integral hinge 12 has a similarly shaped plastic body 122 and a plastic cap 124 (FIG. 14). To hinge upper frame 8 to lower frame 6, upper frame 8 is provided with a generally hollow cylindrical bottom end 128 (FIG. 14) which curves away from upper frame 8 and is adapted at each side for frictional insertion into hinge 10, 12, respectively (FIG. 14). For example, one side of cylindrical bottom end 128 of upper frame 8 is inserted at end 111 of hinge 10 (FIGS. 5, 14). Other hinging configurations may be used, provided such other hinging configurations agree with the intended purpose of the present invention.

Figure 2:
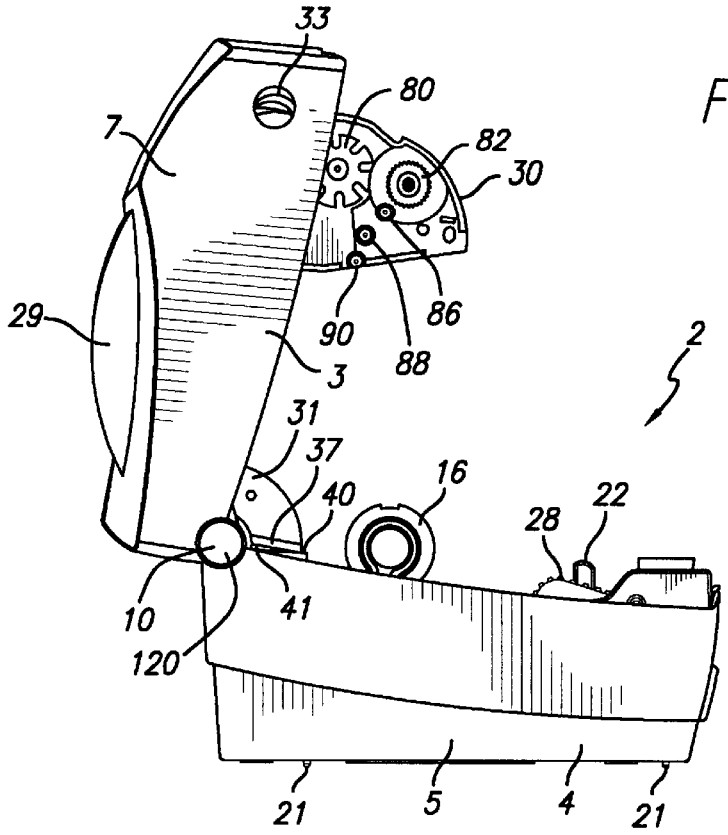
FIG. 2 is a side view of the printer of FIG. 1 in accordance with the present invention.

A person skilled in the art would appreciate that the angular range of motion for lid 3 about printer hinges 10, 12 and for linkage 102 about lever arm 110 would vary based on printer configuration. As an example, lid 3 may be designed to sweep through an angle of about 83 degrees about printer hinges 10, 12 from a fully closed to a fully open position. In such a case, linkage 102 may be designed to sweep through an angle of 80.9 degrees about lever arm 110 from a fully "down" to a fully "up" position. A fully "down" position for linkage 102 would correspond to ribbon carriage post 100 being in maximum "up" position at top end 75 of slot 104 of linkage 102, i.e. lid 3 is fully closed. A fully "up" position for linkage 102 would correspond to ribbon carriage post 100 being in maximum "down" position at bottom end 77 of slot 104 of linkage 102, i.e. lid 3 is fully open (latched) and ribbon carriage 30 is folded all the way in (inside lid 3) for printhead maintenance. For the same example, the bottom of ribbon carriage 30 may be allowed to sweep through an angle of about 80 degrees about hinge axis 13 from a fully folded in to a fully folded out position (FIGS. 1, 2 and 7).

Furthermore, although printer 2 has been described so far for use as a thermal transfer printer (with ribbon), printer 2 may easily be adapted by the user for direct thermal printing by simply removing the ribbon and its associated ribbon supply and ribbon take up rolls and providing suitable print media. No other modifications to printer 2 are needed. Thus, the above-disclosed setup may also be described as a universal (thermal transfer/direct thermal) printer.

The above-described novel printer uses fewer parts than conventional printers and is designed for easy ribbon loading and equally easy media (e.g., paper) loading which is a major improvement over prior art printers. The inventive printer also provides a low cost, light-weight, and easy printhead access (for printhead maintenance) solution for the average user. Furthermore, the above-described novel lid-hinged ribbon carriage setup makes possible for the first time the loading of ribbon media without having to thread through/around the ribbon mechanism. Moreover, various modifications and variations may be made in the present invention without departing from the scope or spirit of the invention. For example, printhead alignment may be achieved with a single appropriately configured alignment tab which would incorporate the functionality provided by alignment tabs 24, 26.

Figure 17:
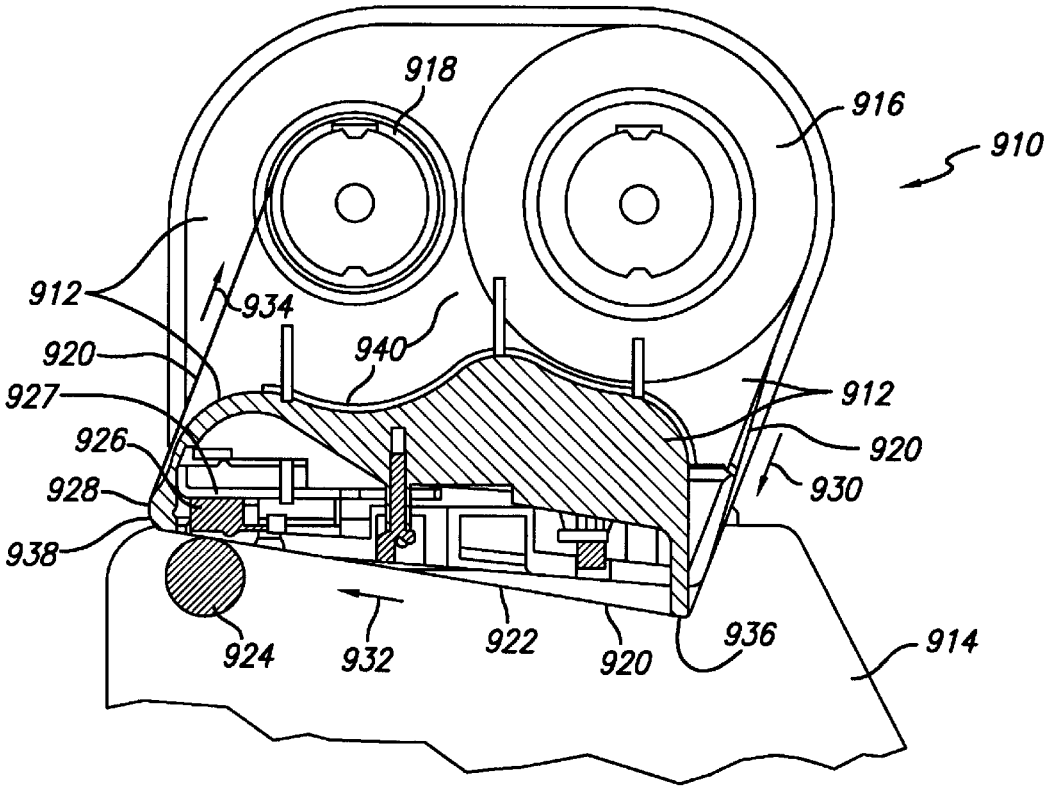
FIG. 17 is a cross-sectional view of a system for dissipating static electric charge in a first thermal transfer printer in accordance with the present invention.
Figure 18B:
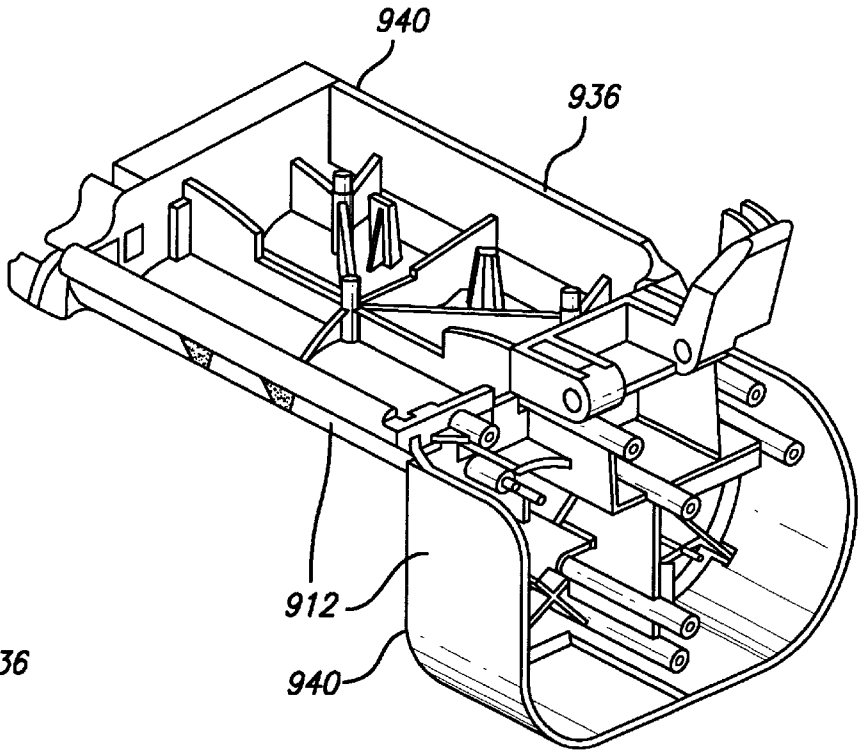
FIG. 18*b* is a bottom perspective view of the system for dissipating static electric charge of FIG. 17 showing ribbon contact surface areas in accordance with the present invention.
Figure 18A:
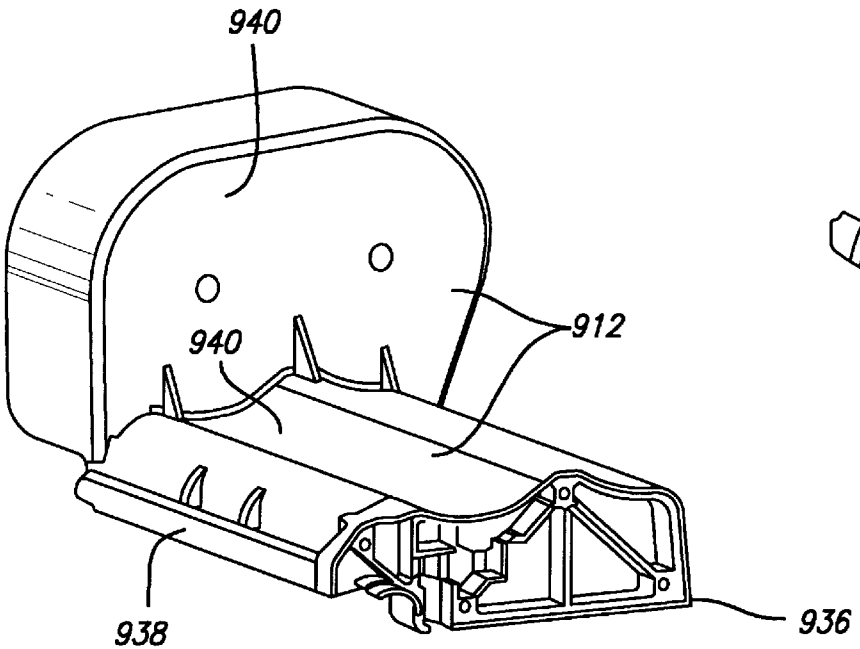
FIG. 18*a* is a top perspective view of the system for dissipating static electric charge of FIG. 17 showing ribbon contact surface areas in accordance with the present invention.
Figure 19:
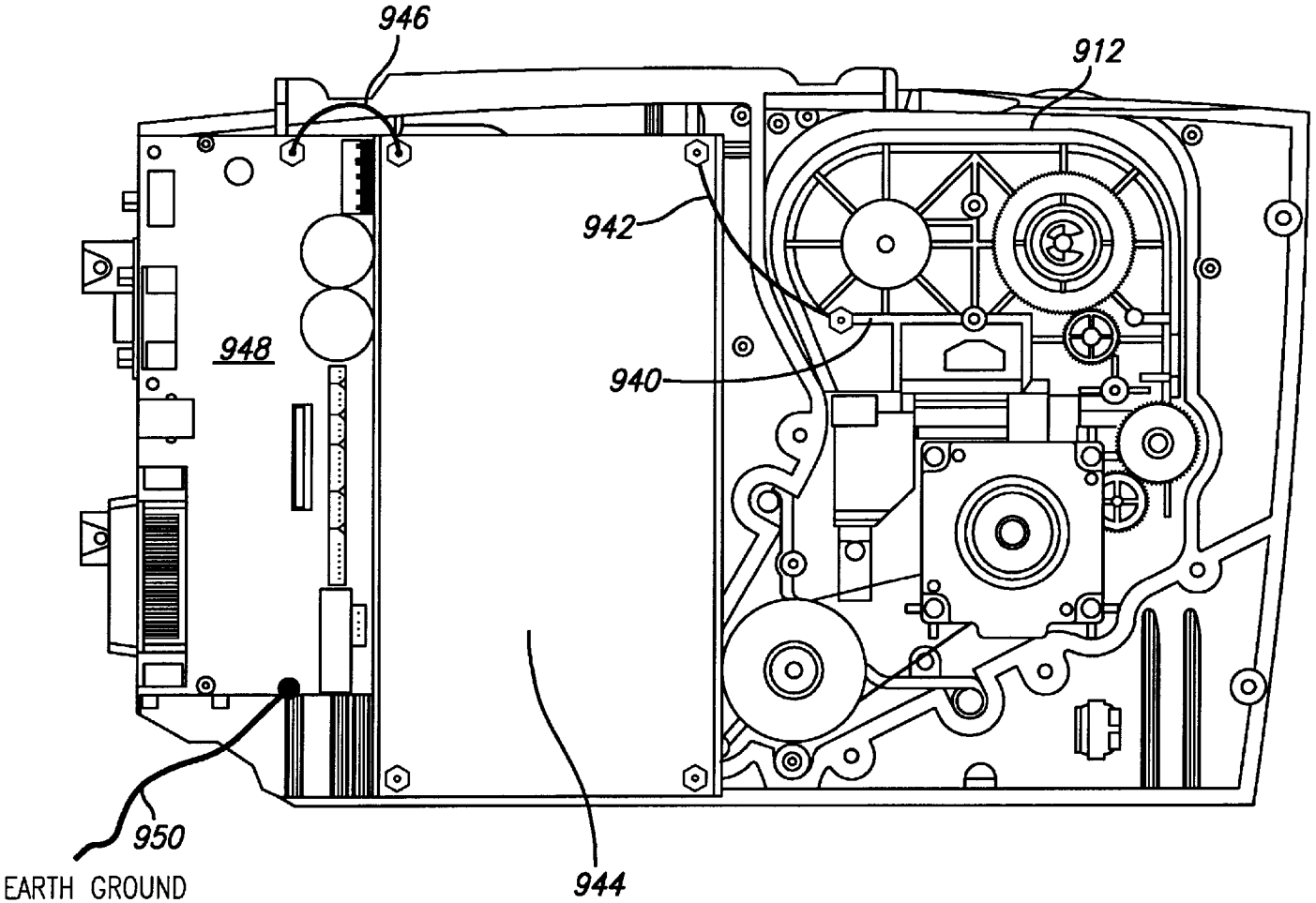
FIG. 19 is a top view of the grounding setup used in the system for dissipating static electric charge of FIG. 17 in accordance with the present invention.

In accordance with yet another preferred embodiment of the present invention and as generally shown in FIGS. 17–19, a system for dissipating a build-up of static electric charge during thermal transfer printing, generally referred to by reference numeral 910, comprises a plastic ribbon frame 912 disposed over a printer base 914 of a thermal transfer printer and adapted to support a ribbon supply roll 916 and a ribbon take up roll 918 which generally define a ribbon path 920 for a moving ribbon 922 which has a Mylar™ film. Ribbon 922 passes between a rotating platen 924 which is rotatably mounted in printer base 914 and a thermal printhead 926 secured under a so-called "bull-nose" portion 928 of ribbon frame 912. Specifically, thermal printhead 926 is mounted on a metal printhead bracket 927 which is removably coupled to the underside of the ribbon frame in close proximity to "bull-nose" portion 928 of ribbon frame 912.

Ribbon 922 is pulled by way of a gear train (not shown) from ribbon supply roll 916 as shown, for example, by directional arrows 930, 932, 934 in FIG. 17 over a ribbon contact surface 936 (FIGS. 18*a*–18*b*) disposed generally in the back of ribbon frame 912 and over a ribbon contact surface 938 (FIG. 18*a*) disposed generally in "bull-nose" portion 928 (FIG. 17) of ribbon frame 912 after it has traveled through the printhead/platen area (defined by rotating platen 924 and thermal printhead 926), i.e. after it has been imaged onto a piece of label stock. Upon exiting the printhead/platen area, ribbon 922 builds up static electric charge caused by the motion of ribbon 922 and the heat produced in the immediate vicinity of the printing elements (not shown) of thermal printhead 926 (FIG. 17) which has to be dissipated to avoid damage to (and possible failure of) thermal printhead 926.

To address the electrostatic charge dissipation issue and in a major departure from the prior art, ribbon frame 912 is preferably made entirely of a statically dissipative, silicone lubricated polycarbonate material 940 (FIGS. 17–18*b*) which is capable of effectively dissipating electrostatic charge by way of an appropriately mounted and earth-grounded ground cable. A material suitable for practicing the present invention may be purchased from LNP Engineering Plastics, Inc. of Exton, Pa. and is available commercially under the trademark name STAT-KON™. The preferred chemical composition of statically dissipative material 940 is sold as STAT-KON™ DCL-4413 and has about 15% carbon fiber, about 2% silicone with the rest being polycarbonate. In general, an approximate range of 5%–30% carbon fiber may be utilized in a material of this kind. Other materials, including other plastic carbon fiber-based compositions, may be used to manufacture a statically dissipative ribbon frame such as ribbon frame 912, provided such other materials do not depart from the intended purpose of the present invention.

As depicted generally in FIG. 19, a ground cable 942 is preferably coupled between STAT-KON™ DCL-4413 ribbon frame 912 and a power supply 944. Power supply 944 is preferably grounded to a printed circuit board assembly (PCBA) 948 via a ground wire 946 as shown in FIG. 19. PCBA 948 is connected in turn to earth ground via a grounding wire 950 as shown on FIG. 19. PCBA 948 is essentially the main circuit board controlling the operation of the printer. Ground cable 942 is preferably screw-mounted on ribbon frame 912 and on power supply 944 as shown in FIG. 19. Ground wire 946 is preferably screw-mounted on power supply 944 and on PCBA 948 and grounding wire 950 is screw-mounted on PCBA 948 and connects to earth ground as generally shown in FIG. 19. A person skilled in the art would recognize that other mounting and/or grounding methods may be utilized, provided such other methods fall within the scope of the present invention.

Electrostatic charge is continuously dissipated as the moving ribbon 922 is in physical contact with ribbon contact surface 938 in the "bull-nose" portion 928 of STAT-KON™ DCL-4413 ribbon frame 912 (FIGS. 17–18*a*) by way of ground cable 942, ground wire 946 and grounding wire 950 (FIG. 19) avoiding the use of static brushes as commonly practiced in the prior art.

Figure 20:
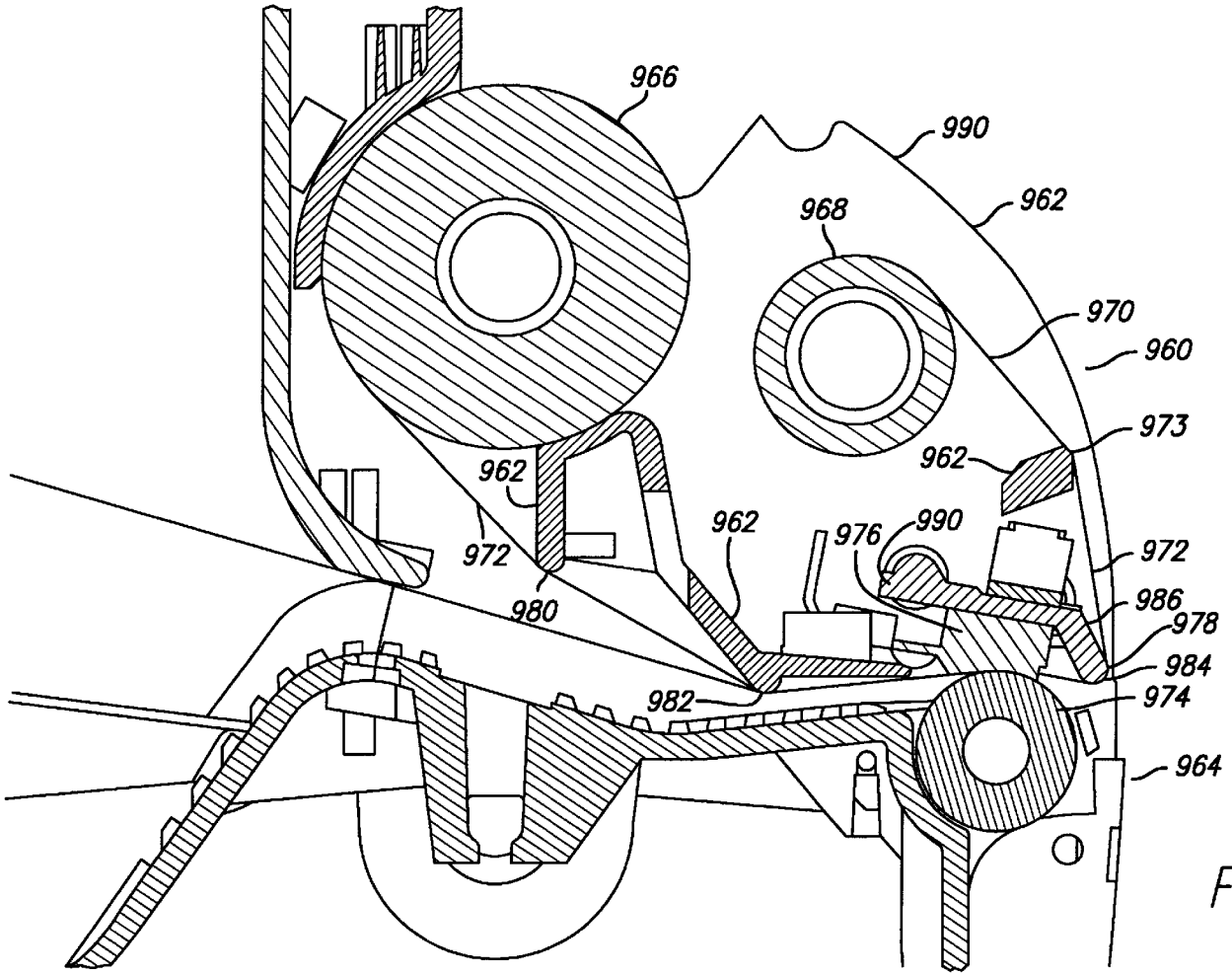
FIG. 20 is a cross-sectional view of a system for dissipating static electric charge in a second thermal transfer printer in accordance with the present invention.
Figure 21:
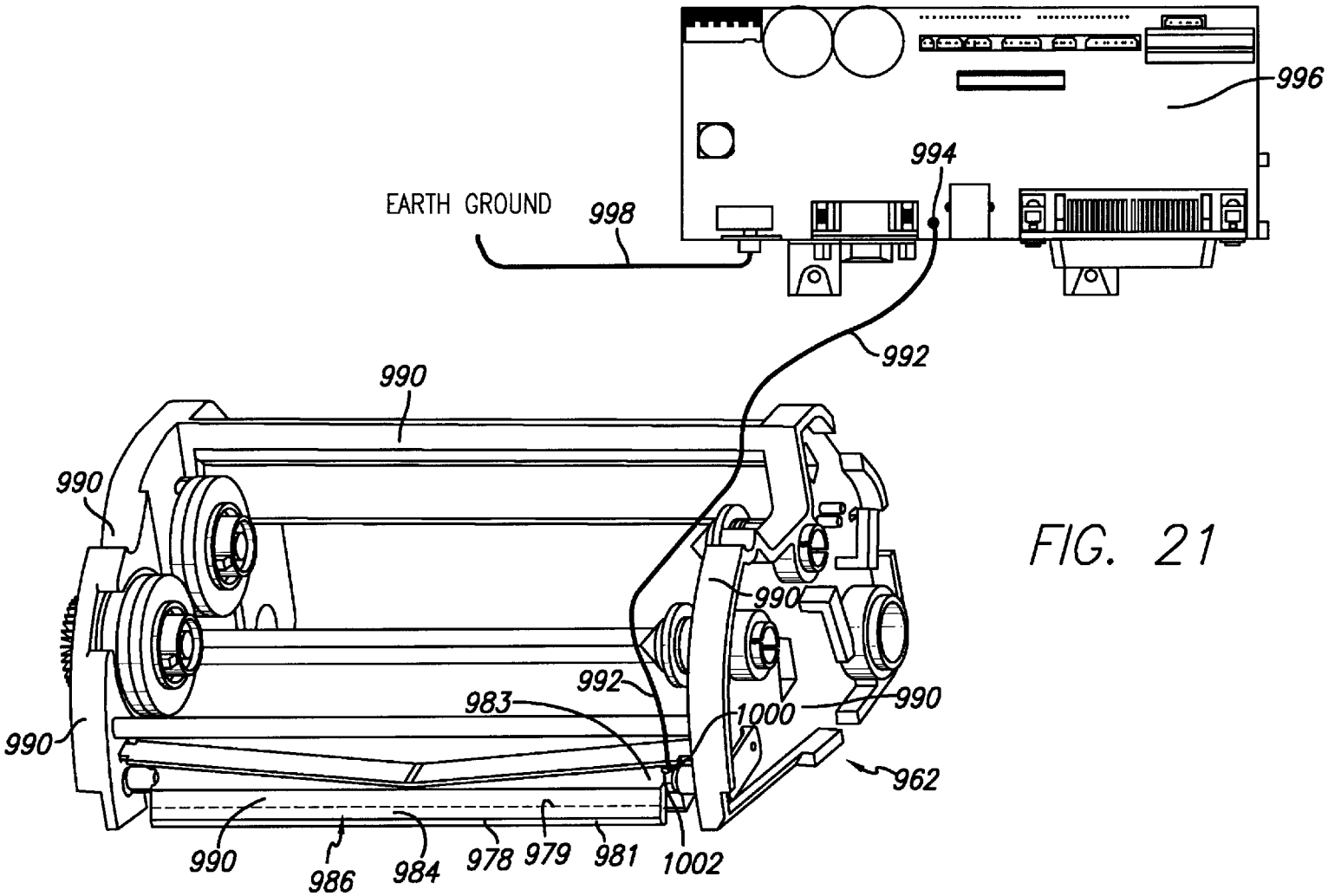
FIG. 21 is a front perspective view of a ribbon frame with a removably mounted printhead bracket grounded to a printed circuit board assembly (PCBA) which is connected to earth ground in accordance with the present invention.

In accordance with still another preferred embodiment of the present invention and as generally illustrated in FIGS. 20–21, a system for dissipating a build-up of static electric charge during printing, generally referred to by reference numeral 960, comprises a plastic ribbon frame 962 disposed over a printer base 964 of a thermal transfer printer. Plastic ribbon frame 962 (FIGS. 20–21) is essentially of the same shape, construction and configuration as ribbon carriage 30 of FIG. 10. Printer base 964 is preferably adapted to support a ribbon supply roll 966 and a ribbon take up roll 968 which generally define a ribbon path 970 for a moving ribbon 972 having a Mylar™ film. Ribbon 972 passes between a rotating platen 974 which is rotatably mounted in printer base 964 and a thermal printhead 976 secured under a so-called "bull-nose" portion 978 of ribbon frame 962. Bull-nose portion 978 is essentially the outermost front portion of a generally V-shaped printhead bracket 986 (FIG. 21) which is removably hinged on each side to ribbon frame 962 (i.e., mounted printhead bracket 986 is in physical contact with ribbon frame 962), i.e. essentially in the same manner as V-shaped printhead support bracket 60 (FIG. 10) is removably hinged at each end to side walls 51, 52 of ribbon carriage 30 (FIG. 10). Printhead bracket 986 is used to support thermal printhead 976 which is preferably screw-mounted under printhead bracket 986 (not shown). Printhead bracket 986 is essentially of the same shape, construction and configuration as printhead support bracket 60 of FIG. 10.

Ribbon 972 is pulled by way of a gear train (not shown) which drives ribbon take up roll 968 over ribbon contact surfaces 980, 982 (FIG. 20) disposed generally at the bottom of ribbon frame 962, over ribbon contact surface 984, generally defined on outer surface 983 of printhead bracket 986 (FIG. 21) and disposed in proximity to the printhead/platen area (defined by rotating platen 974 and thermal printhead 976), and over ribbon contact surface 973 of ribbon frame 962 which is disposed generally between printhead bracket 986 and ribbon take-up roll 968 (FIG. 20).

Specifically, ribbon contact surface 984 includes the outermost edge 981 (FIG. 21) of printhead bracket 986 and about half of outer surface 983 of printhead bracket 986, i.e. up to dash line 979 in FIG. 21. Upon exiting the printhead/platen area, ribbon 972 builds up static electric charge caused by the motion of the ribbon and the heat produced in the immediate vicinity of the printing elements (not shown) of thermal printhead 976 (FIG. 20) which needs to be dissipated to avoid damage to (and possible failure of) thermal printhead 976.

Again, in a major departure from prior art electrostatic dissipation techniques, ribbon frame 962 and printhead bracket 986 are both, preferably, made entirely of a statically dissipative, silicone lubricated polycarbonate material 990 (FIGS. 20–21) which is capable of effectively dissipating electrostatic charge by way of an appropriately mounted and earth-grounded ground cable. A material suitable for practicing the present invention may be purchased from LNP Engineering Plastics, Inc. of Exton, Pa. and is available commercially under the trademark name STAT-KON™. The preferred chemical composition of statically dissipative material 990 is sold as STAT-KON™ DCL-4413 and has about 15% carbon fiber, about 2% silicone with the rest being polycarbonate. In general, an approximate range of 5%–30% carbon fiber may be utilized in a material of this kind. Other materials, including other plastic carbon fiber-based materials, may be used to manufacture ribbon frame 962 and printhead bracket 986, provided such other materials do not depart from the intended purpose of the present invention.

As generally depicted in FIG. 21, the preferred grounding setup comprises a ground cable 992 coupled between STAT-KON™ DCL-4413 printhead bracket 986 and a grounding pin 994 on a printed circuit board assembly (PCBA) 996. PCBA 996 is the main circuit board controlling printer operation and is connected to earth ground via a grounding wire 998 which may be part of the power cable for PCBA 996. Ground cable 992 is preferably mounted at one end to outer surface 983 of printhead bracket 986 by way of a screw 1000 and an aperture 1002 disposed at one end of printhead bracket 986 as shown in FIG. 21. Ground cable 992 is appropriately adapted at the other end (not shown) for coupling to grounding pin 994 on PCBA 996. Grounding pin 994 is part of the grounding circuit (not shown) on PCBA 996. A person skilled in the art would recognize that other mounting and/or grounding methods may be utilized, provided such other methods fall within the scope of the present invention.

Most of the electrostatic charge is dissipated as moving ribbon 972 physically contacts ribbon contact surface 984 (FIGS. 20–21) on STAT-KON™ DCL-4413 printhead bracket 986 (which is mounted on STAT-KON™ DCL-4413 ribbon frame 962) by way of ground cable 992, grounding pin 994 and grounding wire 998 (FIG. 21) avoiding the use of static brushes as commonly practiced in the prior art. Since the entire ribbon frame 962 is made of STAT-KON™ DCL-4413 material, some electrostatic charge dissipation will also occur at ribbon contact surfaces 973, 980 and 982 (FIG. 20). In general, any ribbon contact point on STAT-KON™ DCL-4413 ribbon frame 962 will dissipate electrostatic charge since earth-grounded STAT-KON™ DCL-4413 printhead bracket 986 is mounted on (i.e. it is in physical contact with) STAT-KON™ DCL-4413 ribbon frame 962. The amount of electrostatic charge dissipated by way of ribbon contact areas 973, 980 and 982 is substantially smaller than the amount of electrostatic charge dissipated by way of ribbon contact surface 984 due to the fact that ribbon contact surface 984 (FIG. 21) is disposed in close proximity to thermal printhead 976, i.e. in an area where most of the electrostatic charge build-up occurs during printer operation.

A person skilled in the art would readily recognize that other components and/or configurations may be utilized in the above-described embodiments, provided that such components and/or configurations do not depart from the intended purpose and scope of the present invention.

While the present invention has been described in detail with regards to the above preferred embodiments, it should be appreciated that various modifications and variations may be made in the present invention without departing from the scope or spirit of the invention. In this regard it is important to note that practicing the invention is not limited to the applications described hereinabove. Many other applications and/or alterations may be utilized provided that they do not depart from the intended purpose of the present invention.

It should be appreciated by a person skilled in the art that features illustrated or described as part of one embodiment can be used in another embodiment to provide yet another embodiment such that the features are not limited to the specific embodiments described above. Thus, it is intended that the present invention cover such modifications, embodiments and variations as long as such modifications, embodiments and variations come within the scope of the appended claims and their equivalents.

What is claimed is:

1. A system for dissipating static electric charge build-up caused substantially by the passage of a moving ribbon between a platen and a thermal printhead, said system comprising:

(a) a ribbon frame made substantially of electrostatically dissipative material and adapted to support said thermal printhead proximate to said rotating platen;

(b) a power supply unit electrically coupled to said ribbon frame for grounding said ribbon frame to said power supply; and (c) a printed circuit board assembly (PCBA) electrically coupled between said power supply and earth ground for grounding said power supply, said electrostatically dissipative material in said grounded ribbon frame automatically dissipating static electric charge as said moving ribbon comes into physical contact with at least one portion of said ribbon frame.

2. The system of claim 1, wherein said electrostatically dissipative material comprises about 15% carbon fiber, about 2% silicone and about 83% polycarbonate.

3. The system of claim 1, wherein said electrostatically dissipative material contains about 5% to 30% carbon fiber.

4. The system of claim 1, wherein said ribbon frame is grounded to said power supply unit by way of a ground cable.

5. The system of claim 1, wherein said power supply unit is grounded to said PCBA by way of a ground wire.

6. The system of claim 1, wherein said PCBA is connected to earth ground by way of a grounding wire.

7. The system of claim 1, further comprising:

(d) a printhead bracket removably coupled to said ribbon frame and made substantially of said electrostatically dissipative material, said printhead bracket adapted to support said thermal printhead proximate to said rotating platen; wherein said printed circuit board assembly (PCBA) is also electrically coupled between said printhead bracket and earth ground for grounding said printhead bracket, said electrostatically dissipative material in said grounded printhead bracket automatically dissipating static electric charge as said moving ribbon comes into physical contact with at least one portion of said printhead bracket.

8. The system of claim 7, wherein said electrostatically dissipative material comprises about 15% carbon fiber, about 2% silicone and about 83% polycarbonate.

9. The system of claim 7, wherein said electrostatically dissipative material contains about 5% to 30% carbon fiber.

10. The system of claim 7, wherein said printhead bracket is grounded to said PCBA by way of a ground cable.

11. The system of claim 7, wherein said PCBA is connected to earth ground by way of a grounding wire.

12. The system of claim 7, wherein said electrostatically dissipative material in said ribbon frame automatically dissipates static electric charge as said moving ribbon comes into physical contact with at least one portion of said ribbon frame.

13. A system for dissipating static electric charge build-up from an ink carrier ribbon moving between a platen and a printhead, said system comprising:

a ribbon guide adjacent said printhead and in sliding contact with a surface of the moving ribbon; and a ground electrically coupled to said ribbon guide wherein said guide is formed of an electrostatically dissipative plastic material which automatically dissipates static electric charge from the moving ribbon.

14. The system of claim 13, wherein said electrostatically dissipative plastic material comprises about 15% carbon fiber, about 2% silicone and about 83% polycarbonate.

15. The system of claim 13, wherein said electrostatically dissipative plastic material is a polycarbonate-silicone material containing about 5% to 30% carbon fiber.

16. The system of claim 13, wherein said ribbon guide has a bull nose profile and is an integral portion of a ribbon frame.

17. The system of claim 13, wherein said ribbon guide has a bull nose profile and is an integral portion of a printhead bracket pivotally mounted to a ribbon frame.

* * * * *